US010021500B2

(12) United States Patent
Xu et al.

(10) Patent No.: US 10,021,500 B2
(45) Date of Patent: Jul. 10, 2018

(54) AUDIO FILE PLAYING METHOD AND APPARATUS

(71) Applicant: HUAWEI TECHNOLOGIES CO., LTD., Shenzhen (CN)

(72) Inventors: Jianfeng Xu, Shenzhen (CN); Xiangjun Wang, Shenzhen (CN); Qing Zhang, Munich (DE)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 163 days.

(21) Appl. No.: 15/057,508

(22) Filed: Mar. 1, 2016

(65) Prior Publication Data

US 2016/0183023 A1 Jun. 23, 2016

Related U.S. Application Data

(63) Continuation of application No. PCT/CN2014/076035, filed on Apr. 23, 2014.

(30) Foreign Application Priority Data

Sep. 2, 2013 (CN) ..... 2013 1 0393430

(51) Int. Cl.
*H04R 5/00* (2006.01)
*H04S 5/02* (2006.01)
(Continued)

(52) U.S. Cl.
CPC ..... *H04S 5/02* (2013.01); *G10L 19/008* (2013.01); *G10L 19/0204* (2013.01);
(Continued)

(58) Field of Classification Search
CPC ..... G10L 19/008; G10L 19/0204; H04R 2499/11; H04S 2400/05; H04S 2420/07; H04S 5/02
(Continued)

(56) References Cited

U.S. PATENT DOCUMENTS

| | | | |
|---|---|---|---|
| 5,878,080 | A | 3/1999 | Ten Kate |
| 7,246,367 | B2 | 7/2007 | Ilvonen |
| 2008/0049944 | A1 | 2/2008 | Omata |

FOREIGN PATENT DOCUMENTS

| | | | |
|---|---|---|---|
| CN | 1188572 | A | 7/1998 |
| CN | 1524399 | A | 8/2004 |

(Continued)

OTHER PUBLICATIONS

International Search Report dated Aug. 4, 2014 in corresponding International Patent Application No. PCT/CN2014/076035.

(Continued)

*Primary Examiner* — Vivian Chin
*Assistant Examiner* — Ammar Hamid
(74) *Attorney, Agent, or Firm* — Staas & Halsey LLP

(57) ABSTRACT

An audio file playing method and an apparatus are disclosed and are used to: when an audio file is played, expand a quantity of audio channel signals in the audio file and improve a playing effect of the audio file. The method is as follows: after the audio file is obtained, determining, whether the audio file includes an audio channel signal that can be played by the mobile device; if the audio file includes the audio channel signal that can be played by the mobile device, directly playing the audio channel signal. Therefore, when multiple mobile devices are used to play a same audio file, the mobile devices can avoid performing a same operation, thereby increasing a quantity of audio channels of the audio file, expanding a sound field of the audio file, and improving a playing effect of the audio file.

15 Claims, 7 Drawing Sheets

(51) Int. Cl.
*H04R 29/00* (2006.01)
*G10L 19/008* (2013.01)
*G10L 19/02* (2013.01)

(52) U.S. Cl.
CPC ..... *H04R 2499/11* (2013.01); *H04S 2400/05* (2013.01); *H04S 2420/07* (2013.01)

(58) Field of Classification Search
USPC ..... 381/17, 58, 74
See application file for complete search history.

(56) References Cited

FOREIGN PATENT DOCUMENTS

| | | | | |
|---|---|---|---|---|
| CN | 101465910 | A | | 6/2009 |
| CN | 101547245 | A | * | 9/2009 |
| CN | 102340730 | A | | 2/2012 |
| CN | 102387171 | A | | 3/2012 |
| CN | 103067848 | A | | 4/2013 |
| KR | 10-2011-0102708 | | | 9/2011 |
| WO | 02/063925 | A2 | | 8/2002 |

OTHER PUBLICATIONS

Chinese Office Action dated Nov. 22, 2016 in corresponding Chinese Patent Application No. 201310393430.X.
International Search Report dated Aug. 4, 2014, in corresponding International Application No. PCT/CN2014/076035.

* cited by examiner

AUDIO FILE PLAYING METHOD AND APPARATUS

CROSS-REFERENCE TO RELATED APPLICATIONS

This application is a continuation of International Application No. PCT/CN2014/076035, filed on Apr. 23, 2014, which claims priority to Chinese Patent Application No. 201310393430.X, filed on Sep. 2, 2013, both of which are hereby incorporated by reference in their entireties.

TECHNICAL FIELD

Embodiments of the present invention relate to audio file, and in particular, to an audio file playing method and an apparatus.

BACKGROUND

In recent years, there are more smartphone users and handheld tablet device users. Music playing on a traditional mobile device is mostly performed by a same device. Multiple mobile devices collaboratively play a same piece of music, which can increase volume or expand a sound field, improving user experience. However, an audio channel of an audio file (for example, MP3) that is currently widely used by a user is generally mono or binaural (that is, stereo), and a quantity of audio files in a multichannel format (for example, 5.1) is relatively small. If the multiple mobile devices are simply used to play a same audio file, only audio volume is increased and an audio sound field cannot be expanded.

For example, a first solution in the prior art is to use two or more mobile devices to play a mono audio file, where each mobile device plays a same audio signal. For example, referring to FIG. 1, a mobile device 1, a mobile device 2, and a mobile device 3 all play a same mono audio file.

For another example, a second solution in the prior art is to use two or more mobile devices to play a stereo audio file, where some mobile devices play a left audio channel signal of the stereo audio file, and some mobile devices play a right audio channel signal of the stereo audio file. For example, referring to FIG. 2, a mobile device 1 and a mobile device 2 play a left audio channel signal of a same stereo audio file, and a mobile device 3 and a mobile device 4 play a right audio channel signal of the same stereo audio file.

For still another example, a third solution in the prior art is to use multiple mobile devices to play a multichannel audio file (for example, 5.1 channel), where different mobile devices are responsible for playing different audio channel signals. For example, referring to FIG. 3, a mobile device 1 plays a center audio channel signal of a same 5.1-channel audio file, a mobile device 2 plays a left audio channel signal of the same 5.1-channel audio file, a mobile device 3 plays a right audio channel signal of the same 5.1-channel audio file, a mobile device 4 plays a rear-left audio channel signal of the same 5.1-channel audio file, and a mobile device 5 plays a rear-right audio channel signal of the same 5.1-channel audio file.

However, the multiple mobile devices are used to respectively play audio channel signals of the 5.1-channel audio file. Although the (multiple) played audio channel signals are more than the mono signal and the stereo signal, only playing volume is increased and a quantity of the audio channel signals cannot be increased or expanded, that is, an original audio file needs to be multichannel. If the original audio file is stereo or mono, it is impossible to convert, in real time, the original audio file into a multichannel audio file for playing.

SUMMARY

Embodiments of the present invention provide an audio file playing method and an apparatus, which are used to: when an audio file is played, expand a quantity of audio channel signals of the audio file and improve a playing effect of the audio file.

Specific technical solutions provided in the embodiments of the present invention are as follows:

According to a first aspect, an audio file playing method is provided, including:

acquiring an audio file, and acquiring an audio channel signal included in the audio file;

acquiring a prestored audio channel identifier;

playing, if the acquired audio channel signal matches the audio channel identifier, the audio channel signal that matches the audio channel identifier; and generating, if the acquired audio channel signal does not match the audio channel identifier, and based on a joint covariance matrix coefficient and a joint covariance angle that are corresponding to the audio channel signal included in the audio file, an audio channel signal that matches the audio channel identifier, and playing the generated audio channel signal that matches the audio channel identifier.

With reference to the first aspect, in a first possible implementation manner, the playing, if the acquired audio channel signal matches the audio channel identifier, the audio channel signal that matches the audio channel identifier includes:

if the audio file is a stereo audio file, when it is determined that the audio channel identifier is a left audio channel identifier, confirming that the acquired audio channel signal matches the audio channel identifier, and directly playing a left audio channel signal included in the stereo audio file; or when it is determined that the audio channel identifier is a right audio channel identifier, confirming that the acquired audio channel signal matches the audio channel identifier, and directly playing a right audio channel signal included in the stereo audio file; and if the audio file is a mono audio file, when it is determined that the audio channel identifier is a center audio channel identifier, confirming that the acquired audio channel signal matches the audio channel identifier, and directly playing a mono signal in the mono audio file.

With reference to the first aspect, in a second possible implementation manner, the method includes: the generating, if the acquired audio channel signal does not match the audio channel identifier, and based on a joint covariance matrix coefficient and a joint covariance angle that are corresponding to the audio channel signal included in the audio file, an audio channel signal that matches the audio channel identifier, and playing the generated audio channel signal that matches the audio channel identifier includes:

if the audio file is a stereo audio file, generating, according to a joint covariance matrix coefficient and a joint covariance angle that are corresponding to a left audio channel signal and a right audio channel signal that are included in the stereo audio file, an audio channel signal that matches the audio channel identifier; and if the audio file is a mono audio file, first converting, in a full-pass filtering manner, a mono signal included in the mono audio file separately into a left audio channel signal and a right audio channel signal, and then generating, based on a joint covariance matrix coefficient and a joint covariance angle that are corresponding to the converted left audio channel signal and the right audio channel signal, an audio channel signal that matches the audio channel identifier.

With reference to the second possible implementation manner of the first aspect, in a third possible implementation manner, if the audio file is the stereo audio file and the audio channel identifier is a center audio channel identifier, generating, based on the joint covariance matrix coefficient and the joint covariance angle that are corresponding to the left audio channel signal and the right audio channel signal, the audio channel signal that matches the audio channel identifier includes:

converting a left audio channel signal of a current frame into a left audio channel frequency domain signal, and converting a right audio channel signal of the current frame into a right audio channel frequency domain signal;

separately dividing, based on a same subband size, the converted left audio channel frequency domain signal and the right audio channel frequency domain signal into multiple subband frequency domain signals, separately generating, according to a left audio channel subband frequency domain signal and a right audio channel subband frequency domain signal that are corresponding to each subband size, a joint covariance matrix coefficient corresponding to each subband size, and separately performing smoothing processing on the joint covariance matrix coefficient corresponding to each subband size to obtain a smooth joint covariance matrix coefficient corresponding to each subband size;

separately calculating, according to the smooth joint covariance matrix coefficient corresponding to each subband size, a joint covariance angle corresponding to each subband size, and separately performing interframe smoothing on the joint covariance angle corresponding to each subband size to obtain a smooth joint covariance angle corresponding to each subband size;

separately calculating, according to the left audio channel subband frequency domain signal and the right audio channel subband frequency domain signal that are corresponding to each subband size, and the smooth joint covariance angle corresponding to each subband size, a center audio channel subband frequency domain signal corresponding to each subband size; and combining the obtained center audio channel subband frequency domain signals to obtain a center audio channel frequency domain signal, and performing an inverse frequency domain transform on the center audio channel frequency domain signal to obtain a center audio channel signal.

With reference to the second possible implementation manner of the first aspect, in a fourth possible implementation manner, if the audio file is the stereo audio file or the mono audio file, and the audio channel identifier is a rear-left audio channel identifier or a rear-right audio channel identifier, generating, based on the left audio channel signal and the right audio channel signal, the audio channel signal that matches the audio channel identifier includes:

converting a left audio channel signal of a current frame into a left audio channel frequency domain signal, and converting a right audio channel signal of the current frame into a right audio channel frequency domain signal;

separately dividing, based on a same subband size, the converted left audio channel frequency domain signal and the right audio channel frequency domain signal into multiple subband frequency domain signals, separately generating, according to a left audio channel subband frequency domain signal and a right audio channel subband frequency domain signal that are corresponding to each subband size, a joint covariance matrix coefficient corresponding to each subband size, and separately performing smoothing processing on the joint covariance matrix coefficient corresponding to each subband size to obtain a smooth joint covariance matrix coefficient corresponding to each subband size;

separately calculating, according to the smooth joint covariance matrix coefficient corresponding to each subband size, a joint covariance angle corresponding to each subband size, and separately performing interframe smoothing on the joint covariance angle corresponding to each subband size to obtain a smooth joint covariance angle corresponding to each subband size;

separately calculating, according to the left audio channel subband frequency domain signal and the right audio channel subband frequency domain signal that are corresponding to each subband size, and the smooth joint covariance angle corresponding to each subband size, a rear audio channel subband frequency domain signal corresponding to each subband size;

if the audio channel identifier is the rear-left audio channel identifier, separately obtaining, by means of calculation according to the obtained rear audio channel subband frequency domain signal and the left audio channel subband frequency domain signal that are corresponding to each subband size, a rear-left audio channel subband frequency domain signal corresponding to each subband size, combining the obtained rear-left audio channel subband frequency domain signals to obtain a rear-left audio channel frequency domain signal, and performing an inverse frequency domain transform on the rear-left audio channel frequency domain signal to obtain a rear-left audio channel signal; and if the audio channel identifier is the rear-right audio channel identifier, separately obtaining, by means of calculation according to the obtained rear audio channel subband frequency domain signal and the right audio channel subband frequency domain signal that are corresponding to each subband size, a rear-right audio channel subband frequency domain signal corresponding to each subband size, combining the obtained rear-right audio channel subband frequency domain signals to obtain a rear-right audio channel frequency domain signal, and performing an inverse frequency domain transform on the rear-right audio channel frequency domain signal to obtain a rear-right audio channel signal.

According to a second aspect, a mobile device is provided, including:

an acquiring unit, configured to acquire an audio file, acquire an audio channel signal included in the audio file, and acquire a prestored audio channel identifier; and a processing unit, configured to: when it is determined that the acquired audio channel signal matches the audio channel identifier, play the audio channel signal that matches the audio channel identifier; and when it is determined that the acquired audio channel signal does not match the audio channel identifier, generate, based on a joint covariance matrix coefficient and a joint covariance angle that are corresponding to the audio channel signal included in the audio file, an audio channel signal that matches the audio channel identifier, and play the generated audio channel signal that matches the audio channel identifier.

With reference to the second aspect, in a first possible implementation manner, the processing unit is specifically configured to:

if the audio file is a stereo audio file, when it is determined that the audio channel identifier is a left audio channel identifier, confirm, by the processing unit, that the acquired audio channel signal matches the audio channel identifier, and directly play a left audio channel signal included in the stereo audio file; or when it is determined that the audio channel identifier is a right audio channel identifier, confirm, by the processing unit, that the acquired audio channel signal matches the audio channel identifier, and directly play a right audio channel signal included in the stereo audio file; and if the audio file is a mono audio file, when it is determined that the audio channel identifier is a center audio channel identifier, confirm, by the processing unit, that the acquired audio channel signal matches the audio channel identifier, and directly play a mono signal in the mono audio file.

With reference to the second aspect, in a second possible implementation manner, when it is determined that the acquired audio channel signal does not match the audio channel identifier, the processing unit is specifically configured to:

if the audio file is a stereo audio file, generate, by the processing unit according to a joint covariance matrix coefficient and a joint covariance angle that are corresponding to a left audio channel signal and a right audio channel signal that are included in the stereo audio file, an audio channel signal that matches the audio channel identifier; and if the audio file is a mono audio file, first convert, by the processing unit in a full-pass filtering manner, a mono signal included in the mono audio file separately into a left audio channel signal and a right audio channel signal, and then generate, based on a joint covariance matrix coefficient and a joint covariance angle that are corresponding to the converted left audio channel signal and the right audio channel signal, an audio channel signal that matches the audio channel identifier.

With reference to the second possible implementation manner of the second aspect, in a third possible implementation manner, if the audio file is the stereo audio file and the audio channel identifier is a center audio channel identifier, the processing unit is specifically configured to:

convert a left audio channel signal of a current frame into a left audio channel frequency domain signal, and convert a right audio channel signal of the current frame into a right audio channel frequency domain signal;

separately divide, based on a same subband size, the converted left audio channel frequency domain signal and the right audio channel frequency domain signal into multiple subband frequency domain signals, separately generate, according to a left audio channel subband frequency domain signal and a right audio channel subband frequency domain signal that are corresponding to each subband size, a joint covariance matrix coefficient corresponding to each subband size, and separately perform smoothing processing on the joint covariance matrix coefficient corresponding to each subband size to obtain a smooth joint covariance matrix coefficient corresponding to each subband size;

separately calculate, according to the smooth joint covariance matrix coefficient corresponding to each subband size, a joint covariance angle corresponding to each subband size, and separately perform interframe smoothing on the joint covariance angle corresponding to each subband size to obtain a smooth joint covariance angle corresponding to each subband size;

separately calculate, according to the left audio channel subband frequency domain signal and the right audio channel subband frequency domain signal that are corresponding to each subband size, and the smooth joint covariance angle corresponding to each subband size, a center audio channel subband frequency domain signal corresponding to each subband size; and combine the obtained center audio channel subband frequency domain signals to obtain a center audio channel frequency domain signal, and perform an inverse frequency domain transform on the center audio channel frequency domain signal to obtain a center audio channel signal.

With reference to the second possible implementation manner of the second aspect, in a fourth possible implementation manner, if the audio file is the stereo audio file or the mono audio file, and the audio channel identifier is a rear-left audio channel identifier or a rear-right audio channel identifier, the processing unit is specifically configured to:

convert a left audio channel signal of a current frame into a left audio channel frequency domain signal, and convert a right audio channel signal of the current frame into a right audio channel frequency domain signal;

separately divide, based on a same subband size, the converted left audio channel frequency domain signal and the right audio channel frequency domain signal into multiple subband frequency domain signals, separately generate, according to a left audio channel subband frequency domain signal and a right audio channel subband frequency domain signal that are corresponding to each subband size, a joint covariance matrix coefficient corresponding to each subband size, and separately perform smoothing processing on the joint covariance matrix coefficient corresponding to each subband size to obtain a smooth joint covariance matrix coefficient corresponding to each subband size;

separately calculate, according to the smooth joint covariance matrix coefficient corresponding to each subband size, a joint covariance angle corresponding to each subband size, and separately perform interframe smoothing on the joint covariance angle corresponding to each subband size to obtain a smooth joint covariance angle corresponding to each subband size;

separately calculate, according to the left audio channel subband frequency domain signal and the right audio channel subband frequency domain signal that are corresponding to each subband size, and the smooth joint covariance angle corresponding to each subband size, a rear audio channel subband frequency domain signal corresponding to each subband size;

if the audio channel identifier is the rear-left audio channel identifier, separately obtain, by means of calculation according to the obtained rear audio channel subband frequency domain signal and the left audio channel subband frequency domain signal that are corresponding to each subband size, a rear-left audio channel subband frequency domain signal corresponding to each subband size, combine the obtained rear-left audio channel subband frequency domain signals to obtain a rear-left audio channel frequency domain signal, and perform an inverse frequency domain transform on the rear-left audio channel frequency domain signal to obtain a rear-left audio channel signal; and if the audio channel identifier is the rear-right audio channel identifier, separately obtain, by means of calculation according to the obtained rear audio channel subband frequency domain signal and the right audio channel subband frequency domain signal that are corresponding to each subband size, a rear-right audio channel subband frequency domain signal corresponding to each subband size, combine the obtained rear-right audio channel subband frequency domain signals to obtain a rear-right audio channel frequency domain signal, and perform an inverse frequency domain transform on the rear-right audio channel frequency domain signal to obtain a rear-right audio channel signal.

According to a third aspect, a mobile device is provided, including:

a memory, configured to store an audio file and store a preset audio channel identifier; and a processing unit, configured to: acquire the audio file, acquire an audio channel signal included in the audio file, and acquire the prestored audio channel identifier; when it is determined that the acquired audio channel signal matches the audio channel identifier, play the audio channel signal that matches the audio channel identifier; and when it is determined that the acquired audio channel signal does not match the audio channel identifier, generate, based on a joint covariance matrix coefficient and a joint covariance angle that are corresponding to the audio channel signal included in the audio file, an audio channel signal that matches the audio channel identifier, and play the generated audio channel signal that matches the audio channel identifier.

With reference to the third aspect, in a first possible implementation manner, the processing unit is specifically configured to:

if the audio file is a stereo audio file, when it is determined that the audio channel identifier is a left audio channel identifier, confirm, by the processing unit, that the acquired audio channel signal matches the audio channel identifier, and directly play a left audio channel signal included in the stereo audio file; or when it is determined that the audio channel identifier is a right audio channel identifier, confirm, by the processing unit, that the acquired audio channel signal matches the audio channel identifier, and directly play a right audio channel signal included in the stereo audio file; and if the audio file is a mono audio file, when it is determined that the audio channel identifier is a center audio channel identifier, confirm, by the processing unit, that the acquired audio channel signal matches the audio channel identifier, and directly play a mono signal in the mono audio file.

With reference to the third aspect, in a second possible implementation manner, when it is determined that the acquired audio channel signal does not match the audio channel identifier, the processing unit is specifically configured to:

if the audio file is a stereo audio file, generate, by the processing unit according to a joint covariance matrix coefficient and a joint covariance angle that are corresponding to a left audio channel signal and a right audio channel signal that are included in the stereo audio file, an audio channel signal that matches the audio channel identifier; and if the audio file is a mono audio file, first convert, by the processing unit in a full-pass filtering manner, a mono signal included in the mono audio file separately into a left audio channel signal and a right audio channel signal, and then generate, based on a joint covariance matrix coefficient and a joint covariance angle that are corresponding to the converted left audio channel signal and the right audio channel signal, an audio channel signal that matches the audio channel identifier.

With reference to the second possible implementation manner of the third aspect, in a third possible implementation manner, if the audio file is the stereo audio file and the audio channel identifier is a center audio channel identifier, the processing unit is specifically configured to:

convert a left audio channel signal of a current frame into a left audio channel frequency domain signal, and convert a right audio channel signal of the current frame into a right audio channel frequency domain signal;

separately divide, based on a same subband size, the converted left audio channel frequency domain signal and the right audio channel frequency domain signal into multiple subband frequency domain signals, separately generate, according to a left audio channel subband frequency domain signal and a right audio channel subband frequency domain signal that are corresponding to each subband size, a joint covariance matrix coefficient corresponding to each subband size, and separately perform smoothing processing on the joint covariance matrix coefficient corresponding to each subband size to obtain a smooth joint covariance matrix coefficient corresponding to each subband size;

separately calculate, according to the smooth joint covariance matrix coefficient corresponding to each subband size, a joint covariance angle corresponding to each subband size, and separately perform interframe smoothing on the joint covariance angle corresponding to each subband size to obtain a smooth joint covariance angle corresponding to each subband size;

separately calculate, according to the left audio channel subband frequency domain signal and the right audio channel subband frequency domain signal that are corresponding to each subband size, and the smooth joint covariance angle corresponding to each subband size, a center audio channel subband frequency domain signal corresponding to each subband size; and combine the obtained center audio channel subband frequency domain signals to obtain a center audio channel frequency domain signal, and perform an inverse frequency domain transform on the center audio channel frequency domain signal to obtain a center audio channel signal.

With reference to the second possible implementation manner of the third aspect, in a fourth possible implementation manner, if the audio file is the stereo audio file or the mono audio file, and the audio channel identifier is a rear-left audio channel identifier or a rear-right audio channel identifier, the processing unit is specifically configured to:

convert a left audio channel signal of a current frame into a left audio channel frequency domain signal, and convert a right audio channel signal of the current frame into a right audio channel frequency domain signal;

separately divide, based on a same subband size, the converted left audio channel frequency domain signal and the right audio channel frequency domain signal into multiple subband frequency domain signals, separately generate, according to a left audio channel subband frequency domain signal and a right audio channel subband frequency domain signal that are corresponding to each subband size, a joint covariance matrix coefficient corresponding to each subband size, and separately perform smoothing processing on the joint covariance matrix coefficient corresponding to each subband size to obtain a smooth joint covariance matrix coefficient corresponding to each subband size;

separately calculate, according to the smooth joint covariance matrix coefficient corresponding to each subband size, a joint covariance angle corresponding to each subband size, and separately perform interframe smoothing on the joint covariance angle corresponding to each subband size to obtain a smooth joint covariance angle corresponding to each subband size;

separately calculate, according to the left audio channel subband frequency domain signal and the right audio channel subband frequency domain signal that are corresponding to each subband size, and the smooth joint covariance angle corresponding to each subband size, a rear audio channel subband frequency domain signal corresponding to each subband size;

if the audio channel identifier is the rear-left audio channel identifier, separately obtain, by means of calculation according to the obtained rear audio channel subband frequency domain signal and the left audio channel subband frequency domain signal that are corresponding to each subband size, a rear-left audio channel subband frequency domain signal corresponding to each subband size, combine the obtained rear-left audio channel subband frequency domain signals to obtain a rear-left audio channel frequency domain signal, and perform an inverse frequency domain transform on the rear-left audio channel frequency domain signal to obtain a rear-left audio channel signal; and if the audio channel identifier is the rear-right audio channel identifier, separately obtain, by means of calculation according to the obtained rear audio channel subband frequency domain signal and the right audio channel subband frequency domain signal that are corresponding to each subband size, a rear-right audio channel subband frequency domain signal corresponding to each subband size, combine the obtained rear-right audio channel subband frequency domain signals to obtain a rear-right audio channel frequency domain signal, and perform an inverse frequency domain transform on the rear-right audio channel frequency domain signal to obtain a rear-right audio channel signal.

In conclusion, in the embodiments of the present invention, after obtaining an audio file, a mobile device determines whether the audio file includes an audio channel signal that can be played by the mobile device; and if the audio file includes the audio channel signal that can be played by the mobile device, directly plays the audio channel signal; or if the audio file does not include the audio channel signal that can be played by the mobile device, converts an audio channel signal in the audio file into an audio signal that can be played by the mobile device, and then plays the audio signal. Therefore, when multiple mobile devices are used to play a same audio file, the mobile devices can avoid performing a same operation, thereby increasing a quantity of audio channels of the audio file, expanding a sound field of the audio file, and improving a playing effect of the audio file.

DESCRIPTION OF EMBODIMENTS

To make the objectives, technical solutions, and advantages of the embodiments of the present invention clearer, the following clearly describes the technical solutions in the embodiments of the present invention with reference to the accompanying drawings in the embodiments of the present invention. Apparently, the described embodiments are some but not all of the embodiments of the present invention. All other embodiments obtained by persons of ordinary skill in the art based on the embodiments of the present invention without creative efforts shall fall within the protection scope of the present invention.

When an audio file is played, to expand a quantity of audio channel signals of the audio file and improve a playing effect of the audio file, in the embodiments of the present invention, after obtaining the audio file, a mobile device determines whether the audio file includes an audio channel signal that can be played by the mobile device; and if the audio file includes the audio channel signal that can be played by the mobile device, directly plays the audio channel signal; or if the audio file does not include the audio channel signal that can be played by the mobile device, converts an audio channel signal in the audio file into an audio signal that can be played by the mobile device, and then plays the audio signal. Therefore, when the audio file is played, the quantity of the audio channel signals of the audio file is expanded, and a playing effect of the audio file is improved.

The following describes implementation manners of the present invention in detail with reference to accompanying drawings.

Figure 4:
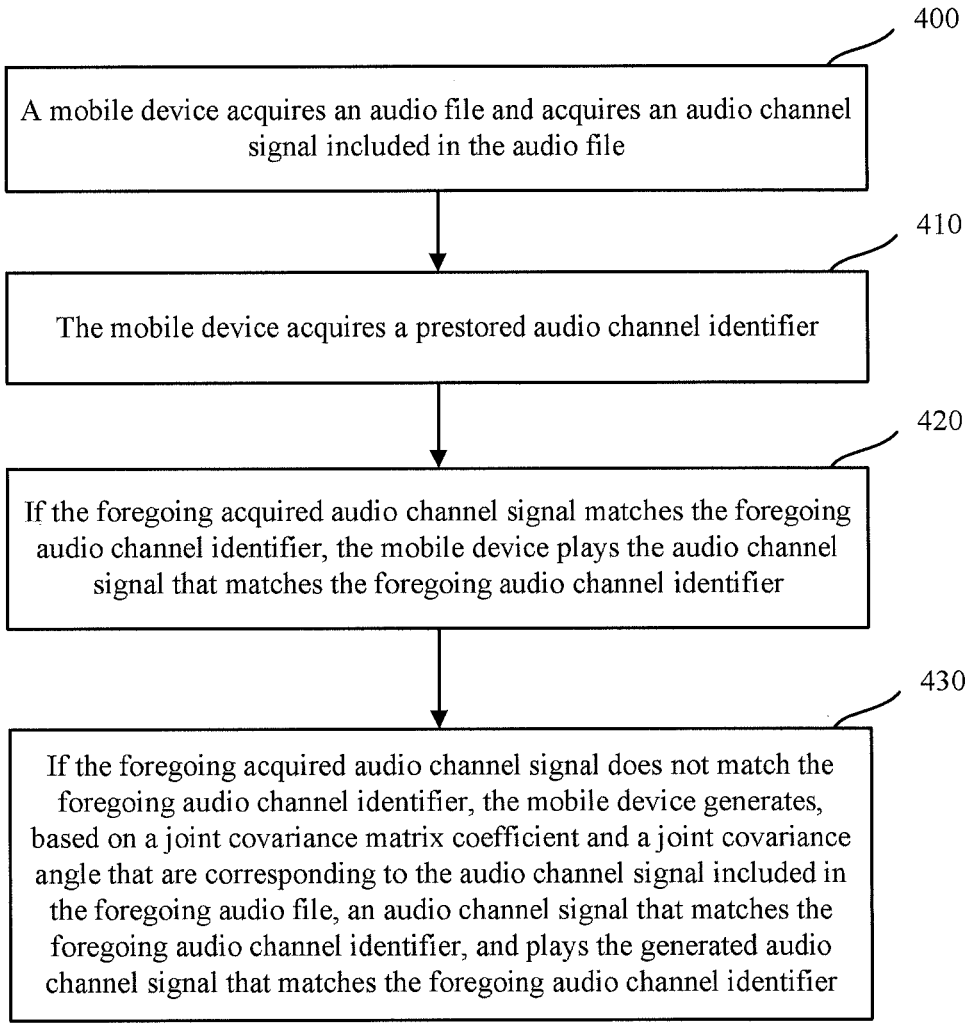
FIG. 4 is a flowchart of playing an audio file according to an embodiment of the present invention.

Referring to FIG. 4, in an embodiment of the present invention, a detailed procedure in which a mobile device plays an audio file is as follows:

Step 400: The mobile device acquires the audio file and acquires an audio channel signal included in the audio file.

Step 410: The mobile device acquires a prestored audio channel identifier.

Step 420: If the foregoing acquired audio channel signal matches the foregoing audio channel identifier, the mobile device plays the audio channel signal that matches the foregoing audio channel identifier.

For example, if the audio file is a stereo audio file, when it is determined that the audio channel identifier is a left audio channel identifier, the mobile device confirms that the acquired audio channel signal matches the audio channel identifier, and directly plays a left audio channel signal included in the stereo audio file; or when it is determined that the audio channel identifier is a right audio channel identifier, the mobile device confirms that the acquired audio channel signal matches the audio channel identifier, and directly plays a right audio channel signal included in the stereo audio file.

For another example, if the audio file is a mono audio file, when it is determined that the audio channel identifier is a center audio channel identifier, the mobile device confirms that the acquired audio channel signal matches the audio channel identifier, and directly plays a mono signal in the mono audio file.

Step 430: If the foregoing acquired audio channel signal does not match the foregoing audio channel identifier, the mobile device generates, based on a joint covariance matrix coefficient and a joint covariance angle that are corresponding to the audio channel signal included in the foregoing audio file, an audio channel signal that matches the foregoing audio channel identifier, and plays the generated audio channel signal that matches the foregoing audio channel identifier.

The joint covariance matrix coefficient reflects a degree of a correlation between power of an audio channel signal and the audio channel signal (for example, a degree of a correlation between power of a left audio channel signal and a right audio channel signal, and between the left audio channel signal and the right audio channel signal); the joint covariance angle reflects azimuth information of a sound source signal in space. Using this manner to calculate the audio channel signal that matches the foregoing audio channel identifier can reduce overall complexity of an algorithm, and therefore can also be implemented on the mobile device.

For example, if the audio file is a stereo audio file, the mobile device generates, according to a joint covariance matrix coefficient and a joint covariance angle that are corresponding to the left audio channel signal and the right audio channel signal that are included in the stereo audio file, an audio channel signal that matches the audio channel identifier.

For another example, if the audio file is a mono audio file, the mobile device first converts, in a full-pass filtering manner, the mono signal included in the mono audio file separately into a left audio channel signal and a right audio channel signal, and then generates, based on a joint covariance matrix coefficient and a joint covariance angle that are corresponding to the converted left audio channel signal and the right audio channel signal, an audio channel signal that matches the audio channel identifier.

It can be learned from the foregoing procedure that in this embodiment of the present invention, when multiple mobile devices collaboratively play a mono audio file or a stereo audio file, each mobile device is set with an audio channel identifier for which the mobile device is responsible (for example, it is assumed that an audio file needs to be converted into a 5.1-channel format for playing. The audio file may be divided into five audio channels: a left audio channel, a right audio channel, a center audio channel, a rear-left audio channel, a rear-right audio channel, and the like. Specific settings may be determined according to a relative position at which the mobile device is located, or may be set by a user.). When the audio file is played, each mobile device converts, in real time, an original audio file into an audio channel signal that matches the audio channel identifier for which the mobile device is responsible, and plays the audio channel signal.

In the following, the stereo audio file and the mono audio file are separately used as examples to further describe, in detail, specific execution of the foregoing step 420.

In a first scenario, it is assumed that the multiple mobile devices collaboratively play the stereo audio file. Each mobile device determines the identifier of an audio channel (for example, a left audio channel, a right audio channel, a center audio channel, a rear-left audio channel, or a rear-right audio channel) in which the mobile device is responsible for playing, where a determining method may be set by a user, or may be determined according to the position at which the mobile device is located. If one mobile device of the multiple mobile devices determines that the mobile device is responsible for playing in the left audio channel or the right audio channel, the mobile device directly plays the left audio channel signal or the right audio channel signal that is included in the stereo audio file. If one mobile device of the multiple mobile devices determines that the mobile device is responsible for playing in a center audio channel, the mobile device needs to convert, in real time, the left audio channel signal and the right audio channel signal that are included in the stereo audio file into a center audio channel signal for playing. If one mobile device of the multiple mobile devices determines that the mobile device is responsible for playing in a rear-left audio channel or a rear-right audio channel, the mobile device needs to convert, in real time, the left audio channel signal and the right audio channel signal that are included in the stereo audio file into a rear-left audio channel signal or a rear-right audio channel signal for playing.

Figure 5:
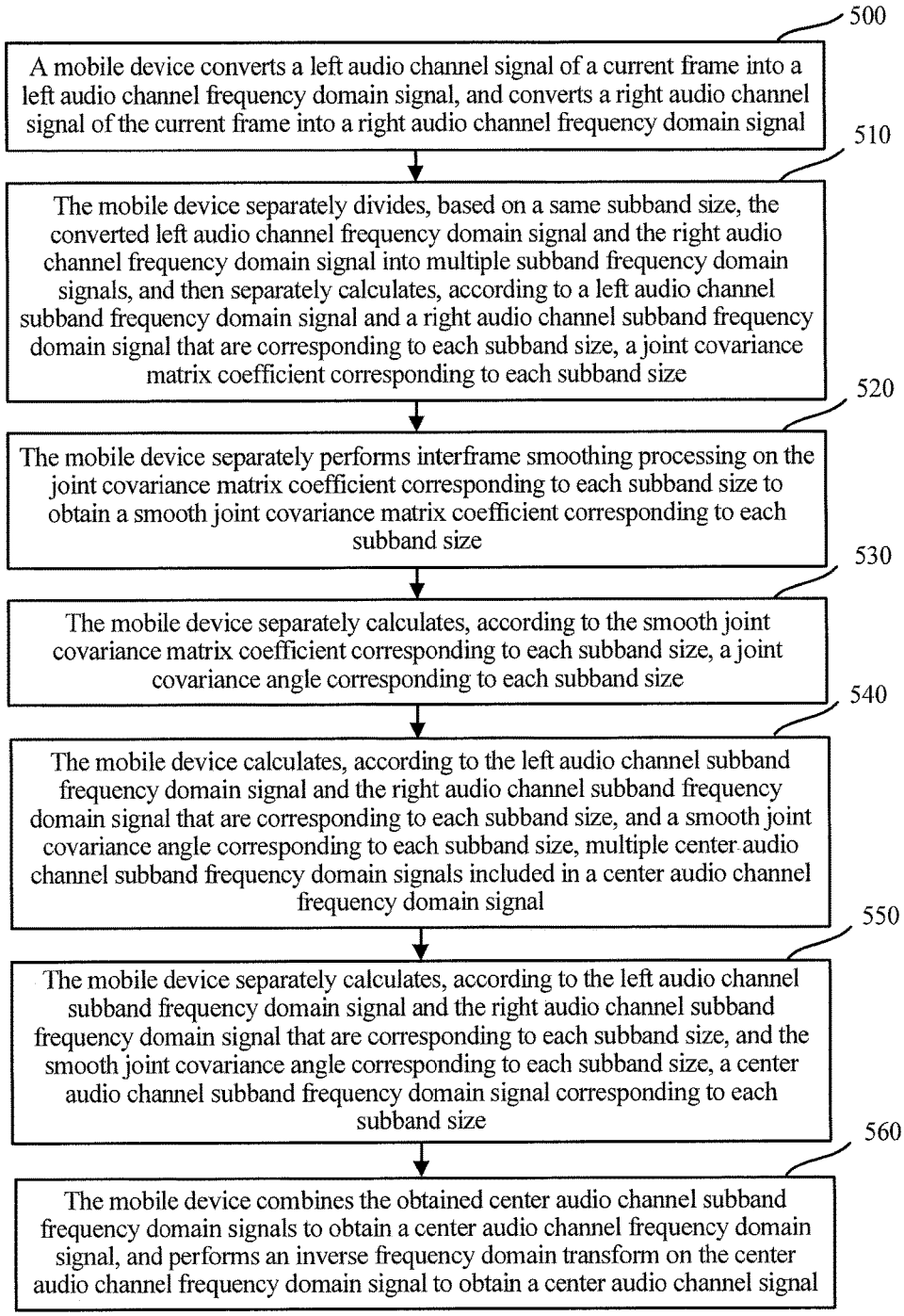
FIG. 5 is a schematic diagram of generating, based on a left audio channel signal and a right audio channel signal, a center audio channel signal according to an embodiment of the present invention.

Referring to FIG. 5, in an embodiment of the present invention, it is assumed that a to-be-played audio file is a stereo audio file, and an audio channel identifier set in a mobile device is a center audio channel identifier. The step of generating, based on a left audio channel signal and a right audio channel signal that are included in the stereo audio file, a center audio channel signal is as follows:

Step 500: The mobile device converts a left audio channel signal of a current frame into a left audio channel frequency domain signal, and converts a right audio channel signal of the current frame into a right audio channel frequency domain signal.

In this embodiment of the present invention, to facilitate real-time conversion and playing, the left audio channel signal and the right audio channel signal that are included in the stereo audio file are separately divided into frames of a same size according to a same standard, where each frame includes a same quantity (for example, quantity N) of sampling points, and N is a positive integer. For example, N=512, or N=1024. A purpose of dividing into frames is to facilitate real-time processing. Each time a frame is processed, audio data obtained after the frame is processed can be directly played and does not need to be played only after the entire stereo audio file is processed. For ease of description, this embodiment in the following is described by using an example of processing a one-frame audio channel signal.

Specifically, in this embodiment of the present invention, for example, methods such as a discrete Fourier transform (DFT), a fast Fourier transform (FFT), and a discrete cosine transform (DCT) can be used for obtaining a left audio channel frequency domain signal $S_L$ after a frequency domain transform is performed on the left audio channel signal of the current frame and for obtaining a right audio channel frequency domain signal $S_R$ after a frequency domain transform is performed on the right audio channel signal of the current frame. The DCT is used as an example, and formulas that may be used for separately performing a frequency domain transform on the left audio channel signal $S_L$ (also referred to as a left audio channel time domain signal) of the current frame and the right audio channel signal $S_R$ (also referred to as a right audio channel time domain signal) of the current frame are as follows:

$$S_L(k) = \sum_{n=0}^{N-1} s_L(n) e^{-i2\pi k \frac{n}{N}} e$$

$$k = 0, \ldots, N-1, \text{ and}$$

$$S_R(k) = \sum_{n=0}^{N-1} s_R(n) e^{-i2\pi k \frac{n}{K}}$$

$$k = 0, \ldots, N-1,$$

where n is a serial number of a sampling point, k is a serial number of a generation point, and e is a natural base.

Essentially, the FFT is a fast algorithm of the DFT. A calculation process of the FFT is different from that of the DFT, but results obtained after the two calculation processes are the same or similar. Because the mobile device generally has a poorer computational capability than a desktop computer and also needs to consider reducing computational complexity to reduce electricity during use a battery, preferably, the FFT may also be used to perform the foregoing calculation process. A signal after a Fourier transform is a complex number, that is, has a real part and an imaginary part.

Step 510: The mobile device separately divides, based on a same subband size, the converted left audio channel frequency domain signal and the right audio channel frequency domain signal $S_R$ into multiple subband frequency domain signals, and then separately calculates, according to a left audio channel subband frequency domain signal and a right audio channel subband frequency domain signal that are corresponding to each subband size, a joint covariance matrix coefficient corresponding to each subband size.

In this embodiment of the present invention, different subband sizes refer to different audio frequency bands. In other words, different subband sizes may be considered as different sound source signals. The mobile device divides, according to consecutive audio frequency bands, the left audio channel frequency domain signal $S_L$ into the left audio channel subband frequency domain signals, and divides, according to the same consecutive audio frequency bands, the right audio channel frequency domain signal $S_R$ into the right audio channel subband frequency domain signals. Therefore, one audio frequency band is corresponding to one left audio channel subband frequency domain signal and one right audio channel subband frequency domain signal.

Any subband size is used as an example. Three joint covariance matrix coefficients are corresponding to the subband size and are respectively represented by $r_{LL}$, $r_{RR}$, and $r_{LR}$. Because for an audio signal, each subband size is corresponding to a different signal distribution, dividing a frequency domain signal into a subband frequency domain signal for processing helps improve quality of the audio signal.

When the joint covariance matrix coefficient corresponding to any subband size is calculated, the following formulas may be used:

$$r_{LL}(k) = \sum_{i=start(k)}^{end(k)} \mathcal{R}(S_L)^2 + I(S_L)^2$$

$$k = 0, \ldots, N_{sb} - 1,$$

$$r_{RR}(k) = \sum_{i=start(k)}^{i=end(k)} \mathcal{R}(S_R)^2 + I(S_R)^2$$

$$k = 0, \ldots, N_{sb} - 1, \text{ and}$$

$$r_{LR}(k) = \sum_{i=start(k)}^{i=end(k)} \mathcal{R}(S_L(i))\mathcal{R}(S_R(i)) + I(S_L(i))I(S_R(i))$$

$$k = 0, \ldots, N_{sb} - 1,$$

where: $N_{sb}$ represents a quantity of subband sizes; k represents an index number of a subband size; i represents an index number of a frequency domain signal; start(k) represents a start point of the $k^{th}$ subband size, and end(k) represents an end point of the $k^{th}$ subband size, where both start(k) and end(k) are positive integers, and end(k)>start(k); $S_L$ represents the left audio channel frequency domain signal; $S_R$ represents the right audio channel frequency domain signal; $\Re$ represents acquisition of a real part of a complex number; and I represents acquisition of an imaginary part of the complex number.

Step 520: The mobile device separately performs inter-frame smoothing processing on the joint covariance matrix coefficient corresponding to each subband size to obtain a smooth joint covariance matrix coefficient corresponding to each subband size.

Specifically, when smoothing processing is performed on the joint covariance matrix coefficient corresponding to any subband size, the following formulas may be used:

$$\bar{r}_{LL}(k)=\bar{r}_{LL}^{-1}(k)\cdot wsm1+r_{LL}(k)\cdot wsm2 \quad k=0, \ldots, N_{sb}-1,$$

$$\bar{r}_{RR}(k)=\bar{r}_{RR}^{-1}(k)\cdot wsm1+r_{RR}(k)\cdot wsm2 \quad k=0, \ldots, N_{sb}-1, \text{ and}$$

$$\bar{r}_{LR}(k)=\bar{r}_{LR}^{-1}(k)\cdot wsm1+r_{LR}(k)\cdot wsm2 \quad k=0, \ldots, N_{sb}-1,$$

where: $\bar{r}_{LL}(k)$, $\bar{r}_{RR}(k)$, and $\bar{r}_{LR}(k)$ represent smooth covariance matrix coefficients corresponding to the $k^{th}$ subband size in the current frame; $\bar{r}_{LL}^{-1}(k)$, $\bar{r}_{RR}^{-1}(k)$, and $\bar{r}_{LR}^{-1}(k)$ represent smooth covariance matrix coefficients corresponding to the $k^{th}$ subband size in a previous frame; wsm1 represents a preset first smooth coefficient, and wsm2 represents a preset second smooth coefficient, where both the first smooth coefficient and the second smooth coefficient are positive numbers, and generally wsm1+wsm2=1. For example, when wsm1=0.8, wsm2=0.2.

Certainly, step 520 is an optimized operation for step 510. According to a different specific application environment, when necessary, step 520 may be skipped, and step 530 is directly performed.

Step 530: The mobile device separately calculates, according to the smooth joint covariance matrix coefficient corresponding to each subband size, a joint covariance angle corresponding to each subband size.

Preferably, an arctan function (that is, a tan) may be used to calculate the joint covariance angle corresponding to any subband size in the foregoing.

Specifically, the following formula may be used:

$$\alpha(k)=a\tan(2\cdot\bar{r}_{LR}(k)/(\bar{r}_{LL}(k)-\bar{r}_{RR}(k)))/2 \quad k=0, \ldots, N_{sb}-1,$$

where $\bar{r}_{LL}(k)$, $\bar{r}_{RR}(k)$, and $\bar{r}_{LR}(k)$ represent smooth joint covariance matrix coefficients corresponding to the $k^{th}$ subband size in the current frame.

Step 540: The mobile device separately performs inter-frame smoothing on the joint covariance angle corresponding to each subband size to obtain a smooth joint covariance angle corresponding to each subband size.

Specifically, smoothing processing may be performed on the joint covariance angle corresponding to any subband size in the foregoing, by using the following formula:

$$\bar{\alpha}(k)=\bar{\alpha}^{-1}(k)\cdot wsm1+\alpha(k)\cdot wsm2 \quad k=0, \ldots, N_{sb}-1,$$

where: $\alpha(k)$ represents a joint covariance angle corresponding to the $k^{th}$ subband size in the current frame; $\bar{\alpha}^{-1}(k)$ represents a smooth joint covariance angle corresponding to the $k^{th}$ subband size in the previous frame; wsm1 represents the preset first smooth coefficient, and wsm2 represents the preset second smooth coefficient, where both the first smooth coefficient and the second smooth coefficient are positive numbers, and generally, wsm1+wsm2=1. For example, when wsm1=0.85, wsm2=0.15.

Certainly, step 540 is an optimized operation for step 530. According to a different specific application environment, when necessary, step 540 may be skipped, and step 550 is directly performed.

Step 550: The mobile device separately calculates, according to the left audio channel subband frequency domain signal and the right audio channel subband frequency domain signal that are corresponding to each subband size, and the smooth joint covariance angle corresponding to each subband size, a center audio channel subband frequency domain signal corresponding to each subband size.

Specifically, the mobile device may calculate any center audio channel subband frequency domain signal by using a weighed addition and using the following formulas:

$$wL(k)=g\cdot\cos(\overline{\alpha}(k))\ k=0,\ldots,N_{sb}-1,$$

$$wR(k)=g\cdot\sin(\overline{\alpha}(k))\ k=0,\ldots,N_{sb}-1,\text{ and}$$

$$S_C(s)=S_L(s)\cdot wL(k)+S_R(s)\cdot wR(k)\ s=\text{start}(k),\ldots,\text{end}(k),$$

where: $S_C(s)$ represents a center audio channel subband frequency domain signal corresponding to the $k^{th}$ subband size, that is, represents a center audio channel subband frequency domain signal formed by multiple points from start(k) to end(k) in a value range of a point s; g represents a preset power control factor whose value is a positive number, for example, $g=\sqrt{2}$; both wL(k) and wR(k) represent preset weighed factors corresponding to the $k^{th}$ subband size; $S_L(s)$ represents a left audio channel subband frequency domain signal corresponding to the $k^{th}$ subband size; $S_R(s)$ represents a right audio channel subband frequency domain signal corresponding to the $k^{th}$ subband size; s represents a serial number of a generation point; start(k) represents the start point of the $k^{th}$ subband size; and end(k) represents the end point of the $k^{th}$ subband size.

Obviously, the corresponding center audio channel subband frequency domain signals are separately calculated according to different subband sizes, that is, the center audio channel subband frequency domain signals are calculated based on different sound source signals. Therefore, accuracy of a finally obtained center audio channel frequency domain signal can be effectively improved. A principle of subsequently calculating another audio channel frequency domain signal by using a different subband size is the same, which is not described herein again.

Step 560: The mobile device combines the obtained center audio channel subband frequency domain signals to obtain a center audio channel frequency domain signal, and performs an inverse frequency domain transform on the center audio channel frequency domain signal to obtain a center audio channel signal (that is, a center audio channel time domain signal).

Specifically, during performing the inverse frequency domain transform, the mobile device may use methods such as an inverse discrete Fourier transform (IDFT), an inverse fast Fourier transform (IFFT), and an inverse discrete cosine transform (IDCT) to obtain a center audio channel signal $s_C(i)$ (time domain). The IDFT is used as an example, where a used formula is as follows:

$$s_C(i)=\frac{1}{\sqrt{N}}\sum_{n=0}^{N-1}S_C(k)e^{j2\pi in/N}$$

$$i=0,\ldots,N-1,$$

where: i represents an index number of a center audio channel time domain signal; $S_C(k)$ represents a center audio channel frequency domain signal; k represents an index number of the center audio channel frequency domain signal; N represents a quantity of sampling points of each frame; e represents the natural base.

Figure 1:
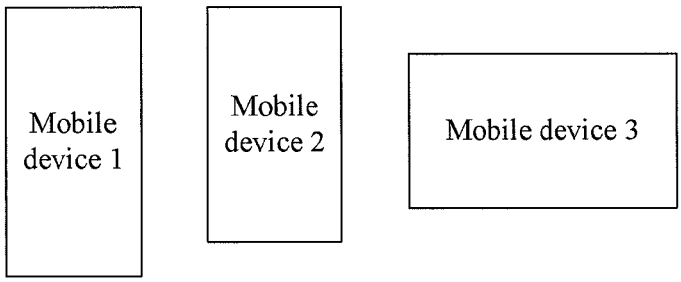
FIG. 1 to FIG. 3 are schematic diagrams of playing a music file according to the prior art.
Figure 2:
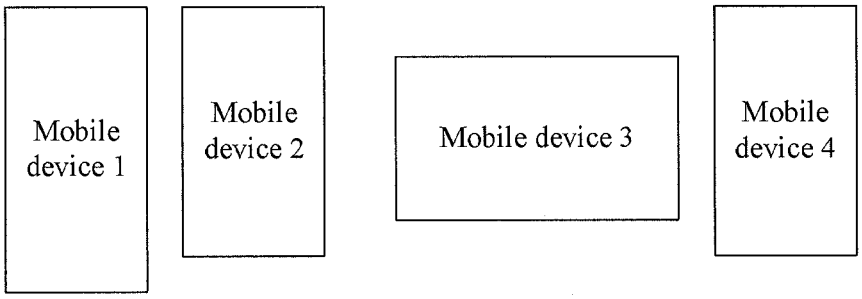
Figure 3:
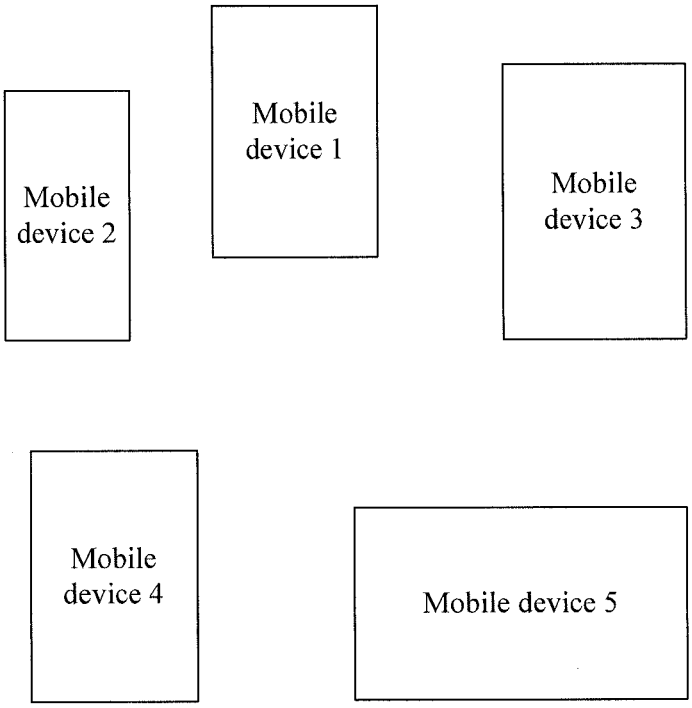

Therefore, when multiple mobile devices obtain a stereo audio file, each mobile device may generate, based on a left audio channel signal and a right audio channel signal that are included in the stereo audio file, an audio channel signal that matches an audio channel identifier of the mobile device for playing. For example, referring to FIG. 3, a mobile device 1 generates, based on a left audio channel signal and a right audio channel signal that are included in a stereo audio file 1, a center audio channel signal for playing; a mobile device 2 directly plays the left audio channel signal included in the stereo audio file; a mobile device 3 directly plays the right audio channel signal included in the stereo audio file; a mobile device 4 generates, based on the left audio channel signal and the right audio channel signal that are included in the stereo audio file 1, a rear-left audio channel signal for playing; a mobile device 5 generates, based on the left audio channel signal and the right audio channel signal that are included in the stereo audio file 1, a rear-right audio channel signal for playing. Obviously, in this manner, the mobile devices can avoid performing a same operation, thereby increasing a quantity of audio channels of the stereo audio file 1, expanding a sound field of the stereo audio file 1, and improving a playing effect of the stereo audio file 1.

Figure 6A:
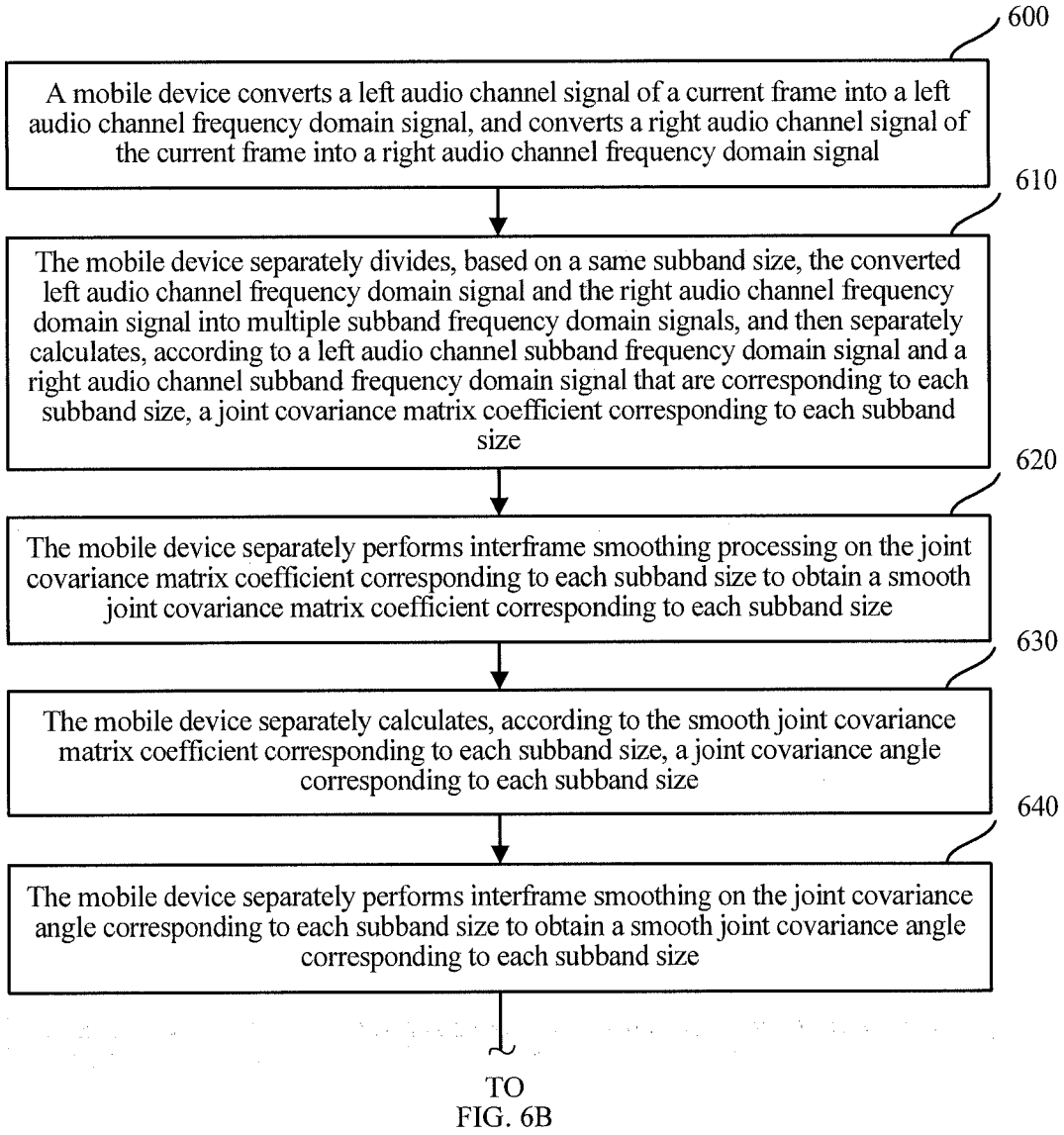
FIG. 6A and FIG. 6B are a schematic diagram of generating, based on a left audio channel signal and a right audio channel signal, a rear-left audio channel signal or a rear-right audio channel signal according to an embodiment of the present invention.
Figure 6B:
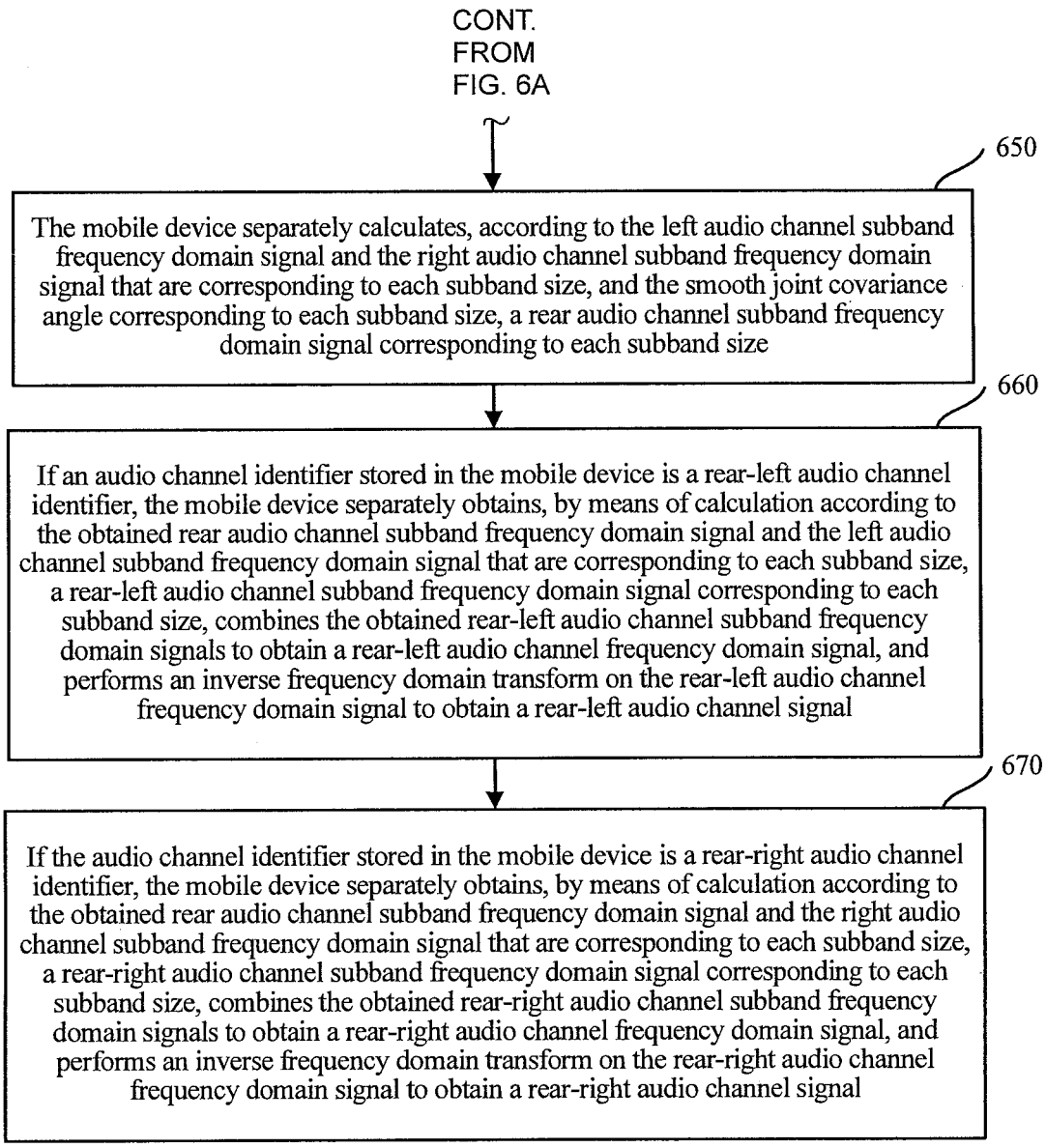

Referring to FIG. 6A and FIG. 6B, in an embodiment of the present invention, it is assumed that a to-be-played audio file is a stereo audio file and an audio channel identifier set in a mobile device is a rear-left audio channel identifier (or a rear-right audio channel identifier). The step of generating, based on a left audio channel signal and a right audio channel signal that are included in the stereo audio file, a rear-left audio channel signal (or a rear-right audio channel signal) is as follows:

Step 600: The mobile device converts a left audio channel signal of a current frame into a left audio channel frequency domain signal, and converts a right audio channel signal of the current frame into a right audio channel frequency domain signal.

In this embodiment of the present invention, to facilitate real-time converting and playing, the left audio channel signal and the right audio channel signal that are included in the stereo audio file are separately divided into frames in a same size according to a same standard, where each frame includes a same quantity (for example, quantity N) of sampling points, and N is a positive integer. For example, N=512, or N=1024. A purpose of dividing into frames is to facilitate real-time processing. Each time a frame is processed, audio data obtained after the frame is processed can be directly played and does not need to be played only after the entire stereo audio file is processed. For ease of description, this embodiment in the following is described by using an example of processing a one-frame audio channel signal.

Specifically, a manner used for performing a frequency domain transform is the same as step 500. For details, reference is made to step 500, which is not described herein again.

Step 610: The mobile device separately divides, based on a same subband size, the converted left audio channel frequency domain signal and the right audio channel frequency domain signal into multiple subband frequency domain signals, and then separately calculates, according to a left audio channel subband frequency domain signal and a right audio channel subband frequency domain signal that are corresponding to each subband size, a joint covariance matrix coefficient corresponding to each subband size.

In this embodiment of the present invention, the manner of generating a joint covariance matrix coefficient is the same as step 510. For details, reference is made to step 510, which is not described herein again.

Step 620: The mobile device separately performs inter-frame smoothing processing on the joint covariance matrix coefficient corresponding to each subband size to obtain a smooth joint covariance matrix coefficient corresponding to each subband size.

In this embodiment of the present invention, the manner of performing smoothing processing on the generated joint covariance matrix coefficient is the same as step 520. For details, reference is made to step 520, which is not described herein again.

Step 630: The mobile device separately calculates, according to the smooth joint covariance matrix coefficient corresponding to each subband size, a joint covariance angle corresponding to each subband size.

In this embodiment of the present invention, the manner of calculating the foregoing joint covariance angle is the same as step 530. For details, reference is made to step 530, which is not described herein again.

Step 640: The mobile device separately performs inter-frame smoothing on the joint covariance angle corresponding to each subband size to obtain a smooth joint covariance angle corresponding to each subband size.

In this embodiment of the present invention, the manner of calculating the foregoing smooth joint covariance angle is the same as step 540. For details, reference is made to step 540, which is not described herein again.

Step 650: The mobile device separately calculates, according to the left audio channel subband frequency domain signal and the right audio channel subband frequency domain signal that are corresponding to each subband size, and the smooth joint covariance angle corresponding to each subband size, a rear audio channel subband frequency domain signal corresponding to each subband size.

Specifically, the mobile device may calculate any rear audio channel subband frequency domain signal by using a weighed subtraction and using the following formulas:

$$wL(k)=g\cdot\cos(\overline{\alpha}(k))\ k=0,\ldots,N_{sb}-1,$$

$$wR(k)=g\cdot\sin(\overline{\alpha}(k))\ k=0,\ldots,N_{sb}1,\text{ and}$$

$$S_S(s)=S_R(s)\cdot wL(k)-S_L(s)\cdot wR(k)\ s=\text{start}(k),\ldots,\text{end}(k),$$

where: $S_S(s)$ represents a rear audio channel subband frequency domain signal corresponding to the $k^{th}$ subband size, that is, represents a rear audio channel subband frequency domain signal formed by multiple points from start(k) to end(k) in a value range of a point s; g represents a preset power control factor whose value is a positive number; for example, g=1.414; both wL(k) and wR(k) represent preset weighed factors corresponding to the $k^{th}$ subband size; $S_L(s)$ represents a left audio channel subband frequency domain signal corresponding to the $k^{th}$ subband size; $S_R(s)$ represents a right audio channel subband frequency domain signal corresponding to the $k^{th}$ subband size; s represents a serial number of a generation point; start(k) represents a start point of the $k^{th}$ subband size; and end(k) represents an end point of the $k^{th}$ subband size.

Because in an actual application, a voice signal is generally transmitted from the front, the voice signal in an audio signal can be relatively well weakened by using a weighed subtraction.

Step 660: If the audio channel identifier stored in the mobile device is the rear-left audio channel identifier, the mobile device separately obtains, by means of calculation according to the obtained rear audio channel subband frequency domain signal and the left audio channel subband frequency domain signal that are corresponding to each subband size, a rear-left audio channel subband frequency domain signal corresponding to each subband size, combines the obtained rear-left audio channel subband frequency domain signals to obtain a rear-left audio channel frequency domain signal, and performs an inverse frequency domain transform on the rear-left audio channel frequency domain signal to obtain a rear-left audio channel signal (that is, a rear-left audio channel time domain signal).

Specifically, the mobile device may calculate any rear-left audio channel subband frequency domain signal, represented by $S_{SL}(s)$, by using a weighed addition and using the following formula:

$$S_{SL}(s)=S_S[s]\cdot w1+S_L[s]\cdot w2\ s=\text{start}(k),\ldots,\text{end}(k),$$

where: $S_{SL}(s)$ represents a rear-left audio channel subband frequency domain signal corresponding to the $k^{th}$ subband size, that is, represents a rear-left audio channel subband frequency domain signal formed by the multiple points from start(k) to end(k) in the value range of the point s; $S_S[s]$ represents a rear audio channel subband frequency domain signal corresponding to the $k^{th}$ subband size; $S_L[s]$ represents the left audio channel subband frequency domain signal corresponding to the $k^{th}$ subband size; w1 represents a preset first weighed coefficient; w2 represents a preset second weighed coefficient; generally, w1+w2=1; for example, w1=0.9, and w2=0.1; s represents the serial number of the generation point; start(k) represents the start point of the $k^{th}$ subband size; and end(k) represents the end point of the $k^{th}$ subband size.

After combining the obtained rear-left audio channel subband frequency domain signals into the rear-left audio channel frequency domain signal, during performing the frequency domain transform on the rear-left audio channel frequency domain signal, the mobile device may use methods such as an inverse discrete Fourier transform (IDFT), an inverse fast Fourier transform (IFFT), and an inverse discrete cosine transform (IDCT) to obtain the rear-left audio channel signal $S_{SL}(i)$ (time domain). The IDFT is used as an example, where a used formula is as follows:

$$s_{SL}(i)=\frac{1}{\sqrt{N}}\sum_{n=0}^{N-1}S_{SL}(k)e^{j2\pi in/N}$$

$$i=0,\ldots,N-1,$$

where: i represents an index number of the rear-left audio channel time domain signal; $S_{SL}(k)$ represents the rear-left audio channel frequency domain signal; k represents an index number of the rear-left audio channel frequency domain signal; N represents a quantity of sampling points of each frame; and e represents a naturalbase.

Step 670: If the audio channel identifier stored in the mobile device is the rear-right audio channel identifier, the mobile device separately obtains, by means of calculation according to the obtained rear audio channel subband frequency domain signal and the right audio channel subband frequency domain signal that are corresponding to each subband size, a rear-right audio channel subband frequency domain signal corresponding to each subband size, combines the obtained rear-right audio channel subband frequency domain signals to obtain a rear-right audio channel frequency domain signal, and performs an inverse frequency domain transform on the rear-right audio channel frequency domain signal to obtain a rear-right audio channel signal (that is, a rear-right audio channel time domain signal).

Specifically, the mobile device may calculate any rear-right audio channel subband frequency domain signal, represented by $S_{SR}(s)$, by using a weighed addition and using the following formula:

$$S_{SR}(s)=S_S[S]\cdot w1+S_R[S]\cdot w2 \quad s=\text{start}(k), \ldots, \text{end}(k),$$

where: $S_{SR}(s)$ represents a rear-right audio channel subband frequency domain signal corresponding to the $k^{th}$ subband size, that is, represents a rear-right audio channel subband frequency domain signal formed by the multiple points from start(k) to end(k) in the value range of the point s; $S_S[s]$ represents the rear audio channel subband frequency domain signal corresponding to the $k^{th}$ subband size; $S_R[s]$ represents the right audio channel subband frequency domain signal corresponding to the $k^{th}$ subband size; w1 represents the preset first weighed coefficient; w2 represents the preset second weighed coefficient; generally, w1+w2=1; for example, w1=0.9, and w2=0.1; s represents the serial number of the generation point; start(k) represents the start point of the $k^{th}$ subband size; and end(k) represents the end point of the $k^{th}$ subband size.

After combining the obtained rear-right audio channel subband frequency domain signals into the rear-right audio channel frequency domain signal, during performing the frequency domain transform on the rear-right audio channel frequency domain signal, the mobile device may use methods such as an inverse discrete Fourier transform (IDFT), an inverse fast Fourier transform (IFFT), and an inverse discrete cosine transform (IDCT) to obtain the rear-right audio channel signal $s_{SR}(i)$ (time domain). The IDFT is used as an example, where a used formula is as follows:

$$s_{SR}(i) = \frac{1}{\sqrt{N}} \sum_{n=0}^{N-1} S_{SR}(k) e^{j2\pi in/N}$$

$$i = 0, \ldots, N-1,$$

where: i represents an index number of the rear-right audio channel time domain signal; $S_{SR}(k)$ represents a rear-right audio channel frequency domain signal; k represents an index number of the rear-right audio channel frequency domain signal; N represents a quantity of sampling points of each frame; and e represents the naturalbase.

The mobile device can remove, by using the foregoing step 650 and step 660, a frequency spectrum hole that may occur in the rear audio channel frequency domain signal $S_S(s)$, which avoids noise caused by a sudden frequency spectrum change between frames.

In a second scenario, it is assumed that multiple mobile devices collaboratively play a mono audio file. Each mobile device determines an identifier of an audio channel (for example, a left audio channel, a right audio channel, a center audio channel, a rear-left audio channel, or a rear-right audio channel) in which the mobile device is responsible for playing, where a determining method may be set by a user, or may be determined according to a position at which the mobile device is located. If one mobile device of the multiple mobile devices determines that the mobile device plays in the center audio channel, the mobile device directly plays a mono signal included in the mono audio file. If one mobile device of the multiple mobile devices determines that the mobile device is responsible for playing in the left audio channel or the right audio channel, the mobile device converts, in a full-pass filtering manner, the mono signal included in the mono audio file into a left audio channel signal or a right audio channel signal for playing. If one mobile device of the multiple mobile devices determines that the mobile device is responsible for playing in a rear-left audio channel or a rear-right audio channel, the mobile device needs to further convert, in real time, the left audio channel signal and the right audio channel signal, which are obtained after the mono signal is converted, into a rear-left audio channel signal or a rear-right audio channel signal for playing.

Specifically, after obtaining the mono audio file, the mobile device first divides the mono signal included in the mono audio file into frames in a same size, where each frame includes a same quantity N of sampling points. In this embodiment of the present invention, to facilitate real-time converting and playing, the mono signal included in the mono audio file is divided into the frames in the same size, where each frame includes the same quantity (for example, quantity N) of sampling points, and N is a positive integer. For example, N=512, or N=1024. A purpose of dividing into frames is to facilitate real-time processing. Each time a frame is processed, audio data obtained after the frame is processed can be directly played and does not need to be played only after the entire mono audio file is processed. For ease of description, this embodiment in the following is described by using an example of processing a one-frame mono signal.

Then, the mobile device performs full-pass filtering on the mono signal $s_M$ of a current frame. A full-pass filter makes signals in all frequency bands of input signals all pass but changes phases and delays of the signals. If the mobile device is responsible for playing in the left audio channel, the mobile device uses a full-pass filter with a delay $d_L$ to obtain a left audio channel signal $S_L$. If the mobile device is responsible for playing in the right audio channel, the mobile device uses a full-pass filter with a delay $d_R$ to obtain a right audio channel signal $S_R$, where both $d_L$ and $d_R$ are nonnegative integers, and $d_L \neq d_R$. For example, $d_L=5$, and $d_R=400$. Full-pass filters with different delays are used for the left and right audio channels, thereby when the mobile devices collaboratively play the mono signal, forming an orientation sense and a stereoscopic sense and converting the mono signal into a stereo signal.

Then, the mobile device may generate, based on the obtained converted left audio channel signal and the right audio channel signal, the rear-left audio channel signal or the rear-right audio channel signal that matches the locally stored audio channel identifier for playing. A specific implementation manner is the same as step 600 to step 660, and details are not described herein again.

Therefore, when multiple mobile devices obtain a mono audio file, each mobile device may convert a mono signal included in the mono audio file into an audio channel signal that matches an audio channel identifier of the mobile device for playing. For example, referring to FIG. 3, a mobile device 1 uses a mono signal included in a mono audio file 1 as a center audio channel signal for playing; a mobile device 2 converts a mono signal included in the mono audio file 1 into a left audio channel signal for playing; a mobile device 3 converts a mono signal included in the mono audio file 1 into a right audio channel signal for playing; a mobile device 4 converts a mono signal included in the mono audio file 1 into a rear-left audio channel signal for playing; a mobile device 5 converts a mono signal included in the mono audio file 1 into a rear-right audio channel signal for playing. Obviously, in this manner, the mobile devices can avoid performing a same operation, thereby increasing a quantity of audio channels of the mono audio file 1, expanding a sound field of the mono audio file 1, and improving a playing effect of the mono audio file 1.

Figure 7:
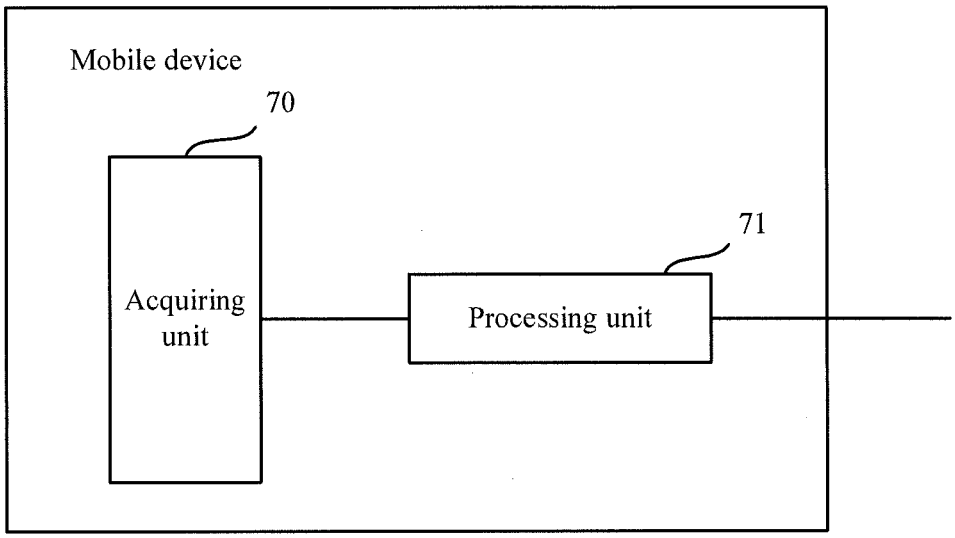
FIG. 7 and FIG. 8 are structural diagrams of a mobile device according to an embodiment of the present invention.

Referring to FIG. 7, to implement the foregoing step 400 to step 430, an embodiment of the present invention provides a mobile device, where the mobile device includes an acquiring unit 70 and a processing unit 71.

The acquiring unit 70 is configured to acquire an audio file, acquire an audio channel signal included in the audio file, and acquire a prestored audio channel identifier.

The processing unit 71 is configured to: when it is determined that the acquired audio channel signal matches the audio channel identifier, play the audio channel signal that matches the audio channel identifier; and when it is determined that the acquired audio channel signal does not match the audio channel identifier, generate, based on a joint covariance matrix coefficient and a joint covariance angle that are corresponding to the audio channel signal included in the audio file, an audio channel signal that matches the audio channel identifier, and play the generated audio channel signal that matches the audio channel identifier.

The processing unit 71 is specifically configured to:

if the audio file is a stereo audio file, when it is determined that the audio channel identifier is a left audio channel identifier, confirm, by the processing unit 71, that the acquired audio channel signal matches the audio channel identifier, and directly play a left audio channel signal included in the stereo audio file; or when it is determined that the audio channel identifier is a right audio channel identifier, confirm, by the processing unit, that the acquired audio channel signal matches the audio channel identifier, and directly play a right audio channel signal included in the stereo audio file; and if the audio file is a mono audio file, when it is determined that the audio channel identifier is a center audio channel identifier, confirm, by the processing unit 71, that the acquired audio channel signal matches the audio channel identifier, and directly play a mono signal in the mono audio file.

When it is determined that the acquired audio channel signal does not match the audio channel identifier, the processing unit 71 is specifically configured to:

if the audio file is a stereo audio file, generate, by the processing unit 71 according to a joint covariance matrix coefficient and a joint covariance angle that are corresponding to a left audio channel signal and a right audio channel signal that are included in the stereo audio file, an audio channel signal that matches the audio channel identifier; and if the audio file is a mono audio file, first convert, by the processing unit 71 in a full-pass filtering manner, a mono signal included in the mono audio file separately into a left audio channel signal and a right audio channel signal, and then generate, based on a joint covariance matrix coefficient and a joint covariance angle that are corresponding to the converted left audio channel signal and the right audio channel signal, an audio channel signal that matches the audio channel identifier.

If the audio file is the stereo audio file and the audio channel identifier is a center audio channel identifier, the processing unit 71 is specifically configured to:

convert a left audio channel signal of a current frame into a left audio channel frequency domain signal, and convert a right audio channel signal of the current frame into a right audio channel frequency domain signal;

separately divide, based on a same subband size, the converted left audio channel frequency domain signal and the right audio channel frequency domain signal into multiple subband frequency domain signals, separately generate, according to a left audio channel subband frequency domain signal and a right audio channel subband frequency domain signal that are corresponding to each subband size, a joint covariance matrix coefficient corresponding to each subband size, and separately perform smoothing processing on the joint covariance matrix coefficient corresponding to each subband size to obtain a smooth joint covariance matrix coefficient corresponding to each subband size;

separately calculate, according to the smooth joint covariance matrix coefficient corresponding to each subband size, a joint covariance angle corresponding to each subband size, and separately perform interframe smoothing on the joint covariance angle corresponding to each subband size to obtain a smooth joint covariance angle corresponding to each subband size;

separately calculate, according to the left audio channel subband frequency domain signal and the right audio channel subband frequency domain signal that are corresponding to each subband size, and the smooth joint covariance angle corresponding to each subband size, a center audio channel subband frequency domain signal corresponding to each subband size; and combine the obtained center audio channel subband frequency domain signals to obtain a center audio channel frequency domain signal, and perform an inverse frequency domain transform on the center audio channel frequency domain signal to obtain a center audio channel signal.

If the audio file is the stereo audio file or the mono audio file, and the audio channel identifier is a rear-left audio channel identifier or a rear-right audio channel identifier, the processing unit 71 is specifically configured to:

convert a left audio channel signal of a current frame into a left audio channel frequency domain signal, and convert a right audio channel signal of the current frame into a right audio channel frequency domain signal;

separately divide, based on a same subband size, the converted left audio channel frequency domain signal and the right audio channel frequency domain signal into multiple subband frequency domain signals, separately generate, according to a left audio channel subband frequency domain signal and a right audio channel subband frequency domain signal that are corresponding to each subband size, a joint covariance matrix coefficient corresponding to each subband size, and separately perform smoothing processing on the joint covariance matrix coefficient corresponding to each subband size to obtain a smooth joint covariance matrix coefficient corresponding to each subband size;

separately calculate, according to the smooth joint covariance matrix coefficient corresponding to each subband size, a joint covariance angle corresponding to each subband size, and separately perform interframe smoothing on the joint covariance angle corresponding to each subband size to obtain a smooth joint covariance angle corresponding to each subband size;

separately calculate, according to the left audio channel subband frequency domain signal and the right audio channel subband frequency domain signal that are corresponding to each subband size, and the smooth joint covariance angle corresponding to each subband size, a rear audio channel subband frequency domain signal corresponding to each subband size;

if the audio channel identifier is the rear-left audio channel identifier, separately obtain, by means of calculation according to the obtained rear audio channel subband frequency domain signal and the left audio channel subband frequency domain signal that are corresponding to each subband size, a rear-left audio channel subband frequency domain signal corresponding to each subband size, combine the obtained rear-left audio channel subband frequency domain signals to obtain a rear-left audio channel frequency domain signal, and perform an inverse frequency domain transform on the rear-left audio channel frequency domain signal to obtain a rear-left audio channel signal; and if the audio channel identifier is the rear-right audio channel identifier, separately obtain, by means of calculation according to the obtained rear audio channel subband frequency domain signal and the right audio channel subband frequency domain signal that are corresponding to each subband size, a rear-right audio channel subband frequency domain signal corresponding to each subband size, combine the obtained rear-right audio channel subband frequency domain signals to obtain a rear-right audio channel frequency domain signal, and perform an inverse frequency domain transform on the rear-right audio channel frequency domain signal to obtain a rear-right audio channel signal.

Figure 8:
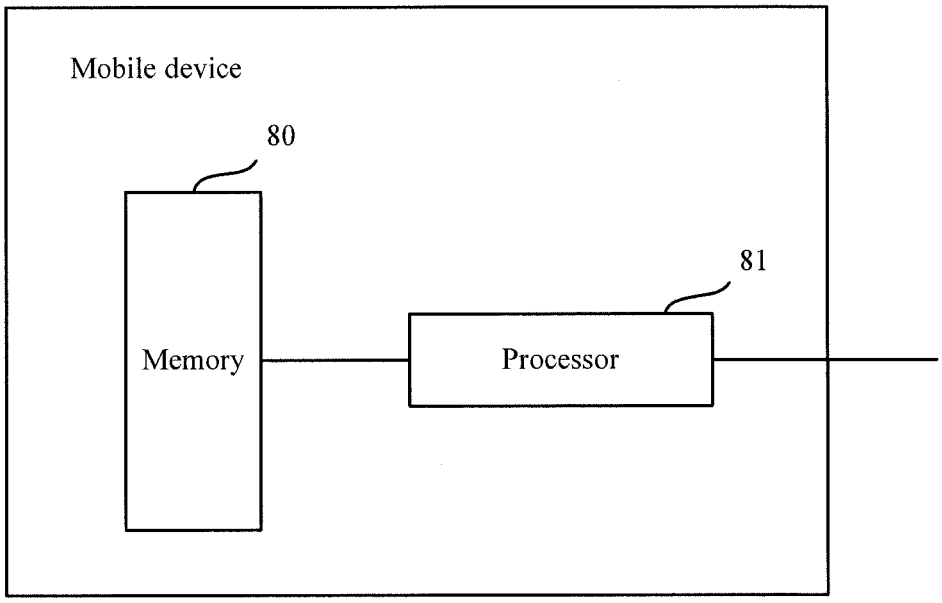

Referring to FIG. 8, to implement the foregoing step 400 to step 430, an embodiment of the present invention provides a mobile device, where the mobile device includes a memory 80 and a processor 81.

The memory 80 is configured to store an audio file and store a preset audio channel identifier.

The processor 81 is configured to: acquire the audio file, acquire an audio channel signal included in the audio file, and acquire the prestored audio channel identifier; when it is determined that the acquired audio channel signal matches the audio channel identifier, play the audio channel signal that matches the audio channel identifier; and when it is determined that the acquired audio channel signal does not match the audio channel identifier, generate, based on a joint covariance matrix coefficient and a joint covariance angle that are corresponding to the audio channel signal included in the audio file, an audio channel signal that matches the audio channel identifier, and play the generated audio channel signal that matches the audio channel identifier.

The processor 81 is specifically configured to:

if the audio file is a stereo audio file, when it is determined that the audio channel identifier is a left audio channel identifier, confirm, by the processor 81, that the acquired audio channel signal matches the audio channel identifier, and directly play a left audio channel signal included in the stereo audio file; or when it is determined that the audio channel identifier is a right audio channel identifier, confirm, by the processor, that the acquired audio channel signal matches the audio channel identifier, and directly play a right audio channel signal included in the stereo audio file; and if the audio file is a mono audio file, when it is determined that the audio channel identifier is a center audio channel identifier, confirm, by the processor 81, that the acquired audio channel signal matches the audio channel identifier, and directly play a mono signal in the mono audio file.

When it is determined that the acquired audio channel signal does not match the audio channel identifier, the processor 81 is specifically configured to:

if the audio file is a stereo audio file, generate, by the processor 81 according to a joint covariance matrix coefficient and a joint covariance angle that are corresponding to a left audio channel signal and a right audio channel signal that are included in the stereo audio file, an audio channel signal that matches the audio channel identifier; and if the audio file is a mono audio file, first convert, by the processor 81 in a full-pass filtering manner, a mono signal included in the mono audio file separately into a left audio channel signal and a right audio channel signal, and then generate, based on a joint covariance matrix coefficient and a joint covariance angle that are corresponding to the converted left audio channel signal and the right audio channel signal, an audio channel signal that matches the audio channel identifier.

If the audio file is the stereo audio file and the audio channel identifier is a center audio channel identifier, the processor 81 is specifically configured to:

convert a left audio channel signal of a current frame into a left audio channel frequency domain signal, and convert a right audio channel signal of the current frame into a right audio channel frequency domain signal;

separately divide, based on a same subband size, the converted left audio channel frequency domain signal and the right audio channel frequency domain signal into multiple subband frequency domain signals, separately generate, according to a left audio channel subband frequency domain signal and a right audio channel subband frequency domain signal that are corresponding to each subband size, a joint covariance matrix coefficient corresponding to each subband size, and separately perform smoothing processing on the joint covariance matrix coefficient corresponding to each subband size to obtain a smooth joint covariance matrix coefficient corresponding to each subband size;

separately calculate, according to the smooth joint covariance matrix coefficient corresponding to each subband size, a joint covariance angle corresponding to each subband size, and separately perform interframe smoothing on the joint covariance angle corresponding to each subband size to obtain a smooth joint covariance angle corresponding to each subband size;

separately calculate, according to the left audio channel subband frequency domain signal and the right audio channel subband frequency domain signal that are corresponding to each subband size, and the smooth joint covariance angle corresponding to each subband size, a center audio channel subband frequency domain signal corresponding to each subband size; and combine the obtained center audio channel subband frequency domain signals to obtain a center audio channel frequency domain signal, and perform an inverse frequency domain transform on the center audio channel frequency domain signal to obtain a center audio channel signal.

If the audio file is the stereo audio file or the mono audio file, and the audio channel identifier is a rear-left audio channel identifier or a rear-right audio channel identifier, the processor 81 is specifically configured to:

convert a left audio channel signal of a current frame into a left audio channel frequency domain signal, and convert a right audio channel signal of the current frame into a right audio channel frequency domain signal;

separately divide, based on a same subband size, the converted left audio channel frequency domain signal and the right audio channel frequency domain signal into multiple subband frequency domain signals, separately generate, according to a left audio channel subband frequency domain signal and a right audio channel subband frequency domain signal that are corresponding to each subband size, a joint covariance matrix coefficient corresponding to each subband size, and separately perform smoothing processing on the joint covariance matrix coefficient corresponding to each subband size to obtain a smooth joint covariance matrix coefficient corresponding to each subband size;

separately calculate, according to the smooth joint covariance matrix coefficient corresponding to each subband size, a joint covariance angle corresponding to each subband size, and separately perform interframe smoothing on the joint covariance angle corresponding to each subband size to obtain a smooth joint covariance angle corresponding to each subband size;

separately calculate, according to the left audio channel subband frequency domain signal and the right audio channel subband frequency domain signal that are corresponding to each subband size, and the smooth joint covariance angle corresponding to each subband size, a rear audio channel subband frequency domain signal corresponding to each subband size;

if the audio channel identifier is the rear-left audio channel identifier, separately obtain, by means of calculation according to the obtained rear audio channel subband frequency domain signal and the left audio channel subband frequency domain signal that are corresponding to each subband size, a rear-left audio channel subband frequency domain signal corresponding to each subband size, combine the obtained rear-left audio channel subband frequency domain signals to obtain a rear-left audio channel frequency domain signal, and perform an inverse frequency domain transform on the rear-left audio channel frequency domain signal to obtain a rear-left audio channel signal; and if the audio channel identifier is the rear-right audio channel identifier, separately obtain, by means of calculation according to the obtained rear audio channel subband frequency domain signal and the right audio channel subband frequency domain signal that are corresponding to each subband size, a rear-right audio channel subband frequency domain signal corresponding to each subband size, combine the obtained rear-right audio channel subband frequency domain signals to obtain a rear-right audio channel frequency domain signal, and perform an inverse frequency domain transform on the rear-right audio channel frequency domain signal to obtain a rear-right audio channel signal.

In conclusion, in this embodiment of the present invention, each mobile device first determines an identifier of an audio channel in which the mobile device is responsible for playing; then, if it is determined that an obtained audio file includes an audio channel signal that matches a local audio channel identifier, directly plays the audio channel signal; and if it is determined that the obtained audio file does not include an audio channel signal that matches the local audio channel identifier, generates, based on the audio channel signal, an audio channel signal that matches the local audio channel identifier and plays the audio channel signal. Therefore, mobile devices avoid performing a same operation, and each mobile device does not need to generate signals in all audio channels, thereby reducing algorithm complexity and helping reduce a workload of the mobile device, so as to reduce electric energy. Further, when multiple mobile devices exist, it can be further ensured that a quantity of audio channels of the audio file is increased according to a usage requirement, thereby expanding a sound field of the audio file, so as to improve a playing effect of the audio file.

Certainly, technical solutions provided in the embodiments of the present invention can be applied to another scenario in which a mono or stereo signal needs to be converted into a multichannel signal, and can also effectively lower a voice in a rear-left audio channel and a rear-right audio channel, where algorithm complexity of the technical solutions is low and sound quality after converting can completely meet a requirement of a user.

Persons skilled in the art should understand that the embodiments of the present invention may be provided as a method, a system, or a computer program product. Therefore, the present invention may use a form of hardware only embodiments, software only embodiments, or embodiments with a combination of software and hardware. Moreover, the present invention may use a form of a computer program product that is implemented on one or more computer-usable storage media (including but not limited to a disk memory, a CD-ROM, an optical memory, and the like) that include computer-usable program code.

The present invention is described with reference to the flowcharts and/or block diagrams of the method, the device (system), and the computer program product according to the embodiments of the present invention. It should be understood that computer program instructions may be used to implement each process and/or each block in the flowcharts and/or the block diagrams and a combination of a process and/or a block in the flowcharts and/or the block diagrams. These computer program instructions may be provided for a general-purpose computer, a dedicated computer, an embedded processor, or a processor of any other programmable data processing device to generate a machine, so that the instructions executed by a computer or a processor of any other programmable data processing device generate an apparatus for implementing a specific function in one or more processes in the flowcharts and/or in one or more blocks in the block diagrams.

These computer program instructions may also be stored in a computer readable memory that can instruct the computer or any other programmable data processing device to work in a specific manner, so that the instructions stored in the computer readable memory generate an artifact that includes an instruction apparatus. The instruction apparatus implements a specific function in one or more processes in the flowcharts and/or in one or more blocks in the block diagrams.

These computer program instructions may also be loaded onto a computer or another programmable data processing device, so that a series of operations and steps are performed on the computer or the another programmable device, thereby generating computer-implemented processing. Therefore, the instructions executed on the computer or the another programmable device provide steps for implementing a specific function in one or more processes in the flowcharts and/or in one or more blocks in the block diagrams.

Although some preferred embodiments of the present invention have been described, persons skilled in the art can make changes and modifications to these embodiments once they learn the basic inventive concept. Therefore, the following claims are intended to be construed as covering the preferred embodiments and all changes and modifications falling within the scope of the present invention.

Obviously, persons skilled in the art can make various modifications and variations to the embodiments of the present invention without departing from the spirit and scope of the embodiments of the present invention. The present invention is intended to cover these modifications and variations provided that they fall within the scope of protection defined by the following claims and their equivalent technologies.

What is claimed is:

1. An audio file playing method, comprising:

acquiring an audio file, and acquiring an audio channel signal comprised in the audio file;

acquiring a prestored audio channel identifier;

playing, when the acquired audio channel signal matches the audio channel identifier, the audio channel signal that matches the audio channel identifier; and generating, when the acquired audio channel signal does not match the audio channel identifier, and based on a joint covariance matrix coefficient and a joint covariance angle that are corresponding to the audio channel signal comprised in the audio file, an audio channel signal that matches the audio channel identifier, and playing the generated audio channel signal that matches the audio channel identifier.

2. The method according to claim 1, wherein the playing, when the acquired audio channel signal matches the audio channel identifier, the audio channel signal that matches the audio channel identifier comprises:

if the audio file is a stereo audio file, when the audio channel identifier is a left audio channel identifier, confirming that the acquired audio channel signal matches the audio channel identifier, and directly playing a left audio channel signal comprised in the stereo audio file; or when the audio channel identifier is a right audio channel identifier, confirming that the acquired audio channel signal matches the audio channel identifier, and directly playing a right audio channel signal comprised in the stereo audio file; and if the audio file is a mono audio file, when the audio channel identifier is a center audio channel identifier, confirming that the acquired audio channel signal matches the audio channel identifier, and directly playing a mono signal in the mono audio file.

3. The method according to claim 1, wherein the generating, when the acquired audio channel signal does not match the audio channel identifier, and based on a joint covariance matrix coefficient and a joint covariance angle that are corresponding to the audio channel signal comprised in the audio file, an audio channel signal that matches the audio channel identifier, and playing the generated audio channel signal that matches the audio channel identifier comprises:

if the audio file is a stereo audio file, generating, according to a joint covariance matrix coefficient and a joint covariance angle that are corresponding to a left audio channel signal and a right audio channel signal that are comprised in the stereo audio file, an audio channel signal that matches the audio channel identifier; and if the audio file is a mono audio file, first converting, in a full-pass filtering manner, a mono signal comprised in the mono audio file separately into a left audio channel signal and a right audio channel signal, and then generating, based on a joint covariance matrix coefficient and a joint covariance angle that are corresponding to the converted left audio channel signal and the right audio channel signal, an audio channel signal that matches the audio channel identifier.

4. The method according to claim 3, wherein if the audio file is the stereo audio file and the audio channel identifier is a center audio channel identifier, generating, based on the joint covariance matrix coefficient and the joint covariance angle that are corresponding to the left audio channel signal and the right audio channel signal, the audio channel signal that matches the audio channel identifier comprises:

converting a left audio channel signal of a current frame into a left audio channel frequency domain signal, and converting a right audio channel signal of the current frame into a right audio channel frequency domain signal;

separately dividing, based on a same subband size, the converted left audio channel frequency domain signal and the right audio channel frequency domain signal into multiple subband frequency domain signals, separately generating, according to a left audio channel subband frequency domain signal and a right audio channel subband frequency domain signal that are corresponding to each subband size, a joint covariance matrix coefficient corresponding to each subband size, and separately performing smoothing processing on the joint covariance matrix coefficient corresponding to each subband size to obtain a smooth joint covariance matrix coefficient corresponding to each subband size;

separately calculating, according to the smooth joint covariance matrix coefficient corresponding to each subband size, a joint covariance angle corresponding to each subband size, and separately performing inter-frame smoothing on the joint covariance angle corresponding to each subband size to obtain a smooth joint covariance angle corresponding to each subband size;

separately calculating, according to the left audio channel subband frequency domain signal and the right audio channel subband frequency domain signal that are corresponding to each subband size, and the smooth joint covariance angle corresponding to each subband size, a center audio channel subband frequency domain signal corresponding to each subband size; and combining the obtained center audio channel subband frequency domain signals to obtain a center audio channel frequency domain signal, and performing an inverse frequency domain transform on the center audio channel frequency domain signal to obtain a center audio channel signal.

5. The method according to claim 3, wherein if the audio file is the stereo audio file or the mono audio file, and the audio channel identifier is a rear-left audio channel identifier or a rear-right audio channel identifier, generating, based on the left audio channel signal and the right audio channel signal, the audio channel signal that matches the audio channel identifier comprises:

converting a left audio channel signal of a current frame into a left audio channel frequency domain signal, and converting a right audio channel signal of the current frame into a right audio channel frequency domain signal;

separately dividing, based on a same subband size, the converted left audio channel frequency domain signal and the right audio channel frequency domain signal into multiple subband frequency domain signals, separately generating, according to a left audio channel subband frequency domain signal and a right audio channel subband frequency domain signal that are corresponding to each subband size, a joint covariance matrix coefficient corresponding to each subband size, and separately performing smoothing processing on the joint covariance matrix coefficient corresponding to each subband size to obtain a smooth joint covariance matrix coefficient corresponding to each subband size;

separately calculating, according to the smooth joint covariance matrix coefficient corresponding to each subband size, a joint covariance angle corresponding to each subband size, and separately performing inter-frame smoothing on the joint covariance angle corresponding to each subband size to obtain a smooth joint covariance angle corresponding to each subband size;

separately calculating, according to the left audio channel subband frequency domain signal and the right audio channel subband frequency domain signal that are corresponding to each subband size, and the smooth joint covariance angle corresponding to each subband size, a rear audio channel subband frequency domain signal corresponding to each subband size;

if the audio channel identifier is the rear-left audio channel identifier, separately obtaining, by means of calculation according to the obtained rear audio channel subband frequency domain signal and the left audio channel subband frequency domain signal that are corresponding to each subband size, a rear-left audio channel subband frequency domain signal corresponding to each subband size, combining the obtained rear-left audio channel subband frequency domain signals to obtain a rear-left audio channel frequency domain signal, and performing an inverse frequency domain transform on the rear-left audio channel frequency domain signal to obtain a rear-left audio channel signal; and if the audio channel identifier is the rear-right audio channel identifier, separately obtaining, by means of calculation according to the obtained rear audio channel subband frequency domain signal and the right audio channel subband frequency domain signal that are corresponding to each subband size, a rear-right audio channel subband frequency domain signal corresponding to each subband size, combining the obtained rear-right audio channel subband frequency domain signals to obtain a rear-right audio channel frequency domain signal, and performing an inverse frequency domain transform on the rear-right audio channel frequency domain signal to obtain a rear-right audio channel signal.

6. A mobile device, comprising:

an acquiring unit, configured to acquire an audio file, acquire an audio channel signal comprised in the audio file, and acquire a prestored audio channel identifier; and a processing unit, configured to: when it is determined that the acquired audio channel signal matches the audio channel identifier, play the audio channel signal that matches the audio channel identifier; and when it is determined that the acquired audio channel signal does not match the audio channel identifier, generate, based on a joint covariance matrix coefficient and a joint covariance angle that are corresponding to the audio channel signal comprised in the audio file, an audio channel signal that matches the audio channel identifier, and play the generated audio channel signal that matches the audio channel identifier.

7. The mobile device according to claim 6, wherein the processing unit is configured to:

if the audio file is a stereo audio file, when it is determined that the audio channel identifier is a left audio channel identifier, confirm, by the processing unit, that the acquired audio channel signal matches the audio channel identifier, and directly play a left audio channel signal comprised in the stereo audio file; or when it is determined that the audio channel identifier is a right audio channel identifier, confirm, by the processing unit, that the acquired audio channel signal matches the audio channel identifier, and directly play a right audio channel signal comprised in the stereo audio file; and if the audio file is a mono audio file, when it is determined that the audio channel identifier is a center audio channel identifier, confirm, by the processing unit, that the acquired audio channel signal matches the audio channel identifier, and directly play a mono signal in the mono audio file.

8. The mobile device according to claim 6, wherein when it is determined that the acquired audio channel signal does not match the audio channel identifier, the processing unit is configured to:

if the audio file is a stereo audio file, generate, by the processing unit according to a joint covariance matrix coefficient and a joint covariance angle that are corresponding to a left audio channel signal and a right audio channel signal that are comprised in the stereo audio file, an audio channel signal that matches the audio channel identifier; and if the audio file is a mono audio file, first convert, by the processing unit in a full-pass filtering manner, a mono signal comprised in the mono audio file separately into a left audio channel signal and a right audio channel signal, and then generate, based on a joint covariance matrix coefficient and a joint covariance angle that are corresponding to the converted left audio channel signal and the right audio channel signal, an audio channel signal that matches the audio channel identifier.

9. The mobile device according to claim 8, wherein if the audio file is the stereo audio file and the audio channel identifier is a center audio channel identifier, the processing unit is configured to:

convert a left audio channel signal of a current frame into a left audio channel frequency domain signal, and convert a right audio channel signal of the current frame into a right audio channel frequency domain signal;

separately divide, based on a same subband size, the converted left audio channel frequency domain signal and the right audio channel frequency domain signal into multiple subband frequency domain signals, separately generate, according to a left audio channel subband frequency domain signal and a right audio channel subband frequency domain signal that are corresponding to each subband size, a joint covariance matrix coefficient corresponding to each subband size, and separately perform smoothing processing on the joint covariance matrix coefficient corresponding to each subband size to obtain a smooth joint covariance matrix coefficient corresponding to each subband size;

separately calculate, according to the smooth joint covariance matrix coefficient corresponding to each subband size, a joint covariance angle corresponding to each subband size, and separately perform interframe smoothing on the joint covariance angle corresponding to each subband size to obtain a smooth joint covariance angle corresponding to each subband size;

separately calculate, according to the left audio channel subband frequency domain signal and the right audio channel subband frequency domain signal that are corresponding to each subband size, and the smooth joint covariance angle corresponding to each subband size, a center audio channel subband frequency domain signal corresponding to each subband size; and combine the obtained center audio channel subband frequency domain signals to obtain a center audio channel frequency domain signal, and perform an inverse frequency domain transform on the center audio channel frequency domain signal to obtain a center audio channel signal.

10. The mobile device according to claim 8, wherein if the audio file is the stereo audio file or the mono audio file, and the audio channel identifier is a rear-left audio channel identifier or a rear-right audio channel identifier, the processing unit is configured to:

convert a left audio channel signal of a current frame into a left audio channel frequency domain signal, and convert a right audio channel signal of the current frame into a right audio channel frequency domain signal;

separately divide, based on a same subband size, the converted left audio channel frequency domain signal and the right audio channel frequency domain signal into multiple subband frequency domain signals, separately generate, according to a left audio channel subband frequency domain signal and a right audio channel subband frequency domain signal that are corresponding to each subband size, a joint covariance matrix coefficient corresponding to each subband size, and separately perform smoothing processing on the joint covariance matrix coefficient corresponding to each subband size to obtain a smooth joint covariance matrix coefficient corresponding to each subband size;

separately calculate, according to the smooth joint covariance matrix coefficient corresponding to each subband size, a joint covariance angle corresponding to each subband size, and separately perform interframe smoothing on the joint covariance angle corresponding to each subband size to obtain a smooth joint covariance angle corresponding to each subband size;

separately calculate, according to the left audio channel subband frequency domain signal and the right audio channel subband frequency domain signal that are corresponding to each subband size, and the smooth joint covariance angle corresponding to each subband size, a rear audio channel subband frequency domain signal corresponding to each subband size;

if the audio channel identifier is the rear-left audio channel identifier, separately obtain, by means of calculation according to the obtained rear audio channel subband frequency domain signal and the left audio channel subband frequency domain signal that are corresponding to each subband size, a rear-left audio channel subband frequency domain signal corresponding to each subband size, combine the obtained rear-left audio channel subband frequency domain signals to obtain a rear-left audio channel frequency domain signal, and perform an inverse frequency domain transform on the rear-left audio channel frequency domain signal to obtain a rear-left audio channel signal; and if the audio channel identifier is the rear-right audio channel identifier, separately obtain, by means of calculation according to the obtained rear audio channel subband frequency domain signal and the right audio channel subband frequency domain signal that are corresponding to each subband size, a rear-right audio channel subband frequency domain signal corresponding to each subband size, combine the obtained rear-right audio channel subband frequency domain signals to obtain a rear-right audio channel frequency domain signal, and perform an inverse frequency domain transform on the rear-right audio channel frequency domain signal to obtain a rear-right audio channel signal.

11. An mobile device, comprising:

a memory for storing computer-executable instructions; and a processor coupled to the memory, wherein the processor is configured, based on execution of the computer-executable instructions, to:

acquire an audio file, and acquire an audio channel signal comprised in the audio file;

acquire a prestored audio channel identifier;

play, when the acquired audio channel signal matches the audio channel identifier, the audio channel signal that matches the audio channel identifier; and generate, when it is determined that the acquired audio channel signal does not match the audio channel identifier, and based on a joint covariance matrix coefficient and a joint covariance angle that are corresponding to the audio channel signal comprised in the audio file, an audio channel signal that matches the audio channel identifier, and play the generated audio channel signal that matches the audio channel identifier.

12. The mobile device according to claim 11, wherein the processor is configured to:

if the audio file is a stereo audio file, when the audio channel identifier is a left audio channel identifier, confirm that the acquired audio channel signal matches the audio channel identifier, and directly play a left audio channel signal comprised in the stereo audio file; or when it is determined that the audio channel identifier is a right audio channel identifier, confirm that the acquired audio channel signal matches the audio channel identifier, and directly play a right audio channel signal comprised in the stereo audio file;

if the audio file is a mono audio file, when it is determined that the audio channel identifier is a center audio channel identifier, confirm that the acquired audio channel signal matches the audio channel identifier, and directly play a mono signal in the mono audio file.

13. The mobile device according to claim 11, wherein the processor is configured to:

if the audio file is a stereo audio file, generate, according to a joint covariance matrix coefficient and a joint covariance angle that are corresponding to a left audio channel signal and a right audio channel signal that are comprised in the stereo audio file, an audio channel signal that matches the audio channel identifier; and if the audio file is a mono audio file, first convert, in a full-pass filtering manner, a mono signal comprised in the mono audio file separately into a left audio channel signal and a right audio channel signal, and then generate, based on a joint covariance matrix coefficient and a joint covariance angle that are corresponding to the converted left audio channel signal and the right audio channel signal, an audio channel signal that matches the audio channel identifier.

14. The mobile device according to claim 13, wherein the processor is configured to:

convert a left audio channel signal of a current frame into a left audio channel frequency domain signal, and convert a right audio channel signal of the current frame into a right audio channel frequency domain signal;

separately divide, based on a same subband size, the converted left audio channel frequency domain signal and the right audio channel frequency domain signal into multiple subband frequency domain signals, separately generate, according to a left audio channel subband frequency domain signal and a right audio channel subband frequency domain signal that are corresponding to each subband size, a joint covariance matrix coefficient corresponding to each subband size, and separately perform smoothing processing on the joint covariance matrix coefficient corresponding to each subband size to obtain a smooth joint covariance matrix coefficient corresponding to each subband size;

separately calculate, according to the smooth joint covariance matrix coefficient corresponding to each subband size, a joint covariance angle corresponding to each subband size, and separately perform interframe smoothing on the joint covariance angle corresponding to each subband size to obtain a smooth joint covariance angle corresponding to each subband size;

separately calculate, according to the left audio channel subband frequency domain signal and the right audio channel subband frequency domain signal that are corresponding to each subband size, and the smooth joint covariance angle corresponding to each subband size, a center audio channel subband frequency domain signal corresponding to each subband size; and combine the obtained center audio channel subband frequency domain signals to obtain a center audio channel frequency domain signal, and perform an inverse frequency domain transform on the center audio channel frequency domain signal to obtain a center audio channel signal.

15. The mobile device according to claim 13, wherein the processor is configured to:

convert a left audio channel signal of a current frame into a left audio channel frequency domain signal, and convert a right audio channel signal of the current frame into a right audio channel frequency domain signal;

separately divide, based on a same subband size, the converted left audio channel frequency domain signal and the right audio channel frequency domain signal into multiple subband frequency domain signals, separately generate, according to a left audio channel subband frequency domain signal and a right audio channel subband frequency domain signal that are corresponding to each subband size, a joint covariance matrix coefficient corresponding to each subband size, and separately perform smoothing processing on the joint covariance matrix coefficient corresponding to each subband size to obtain a smooth joint covariance matrix coefficient corresponding to each subband size;

separately calculate, according to the smooth joint covariance matrix coefficient corresponding to each subband size, a joint covariance angle corresponding to each subband size, and separately perform interframe smoothing on the joint covariance angle corresponding to each subband size to obtain a smooth joint covariance angle corresponding to each subband size;

separately calculate, according to the left audio channel subband frequency domain signal and the right audio channel subband frequency domain signal that are corresponding to each subband size, and the smooth joint covariance angle corresponding to each subband size, a rear audio channel subband frequency domain signal corresponding to each subband size;

if the audio channel identifier is the rear-left audio channel identifier, separately obtain, by means of calculation according to the obtained rear audio channel subband frequency domain signal and the left audio channel subband frequency domain signal that are corresponding to each subband size, a rear-left audio channel subband frequency domain signal corresponding to each subband size, combine the obtained rear-left audio channel subband frequency domain signals to obtain a rear-left audio channel frequency domain signal, and perform an inverse frequency domain transform on the rear-left audio channel frequency domain signal to obtain a rear-left audio channel signal; and if the audio channel identifier is the rear-right audio channel identifier, separately obtain, by means of calculation according to the obtained rear audio channel subband frequency domain signal and the right audio channel subband frequency domain signal that are corresponding to each subband size, a rear-right audio channel subband frequency domain signal corresponding to each subband size, combine the obtained rear-right audio channel subband frequency domain signals to obtain a rear-right audio channel frequency domain signal, and perform an inverse frequency domain transform on the rear-right audio channel frequency domain signal to obtain a rear-right audio channel signal.

* * * * *